US011128951B1

(12) United States Patent
Rady

(10) Patent No.: US 11,128,951 B1
(45) **Date of Patent: *Sep. 21, 2021**

(54) PRIME POLYGON REFLECTORS AND METHODS OF USE

(71) Applicant: Todd F. Rady, Menominee, MI (US)

(72) Inventor: Todd F. Rady, Menominee, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/664,299

(22) Filed: Oct. 25, 2019

Related U.S. Application Data

(63) Continuation-in-part of application No. 16/188,575, filed on Nov. 13, 2018, now Pat. No. 10,462,562.

(51) Int. Cl.
*H04R 1/34* (2006.01)
*H04R 1/02* (2006.01)

(52) U.S. Cl.
CPC ..... *H04R 1/345* (2013.01); *H04R 1/026* (2013.01)

(58) Field of Classification Search
CPC ..... H04R 1/34; H04R 1/323; H04R 1/345; H04R 5/02
See application file for complete search history.

(56) References Cited

U.S. PATENT DOCUMENTS 4,960,468 A * 10/1990 Sinton ..... H02S 99/00 136/259
5,291,331 A * 3/1994 Miano ..... H01L 31/0547 359/598
5,675,131 A * 10/1997 Saito ..... H04R 5/02 181/152
6,009,972 A * 1/2000 Choi ..... H04R 1/345 181/153
6,152,257 A * 11/2000 Denham ..... H04R 1/345 181/144
6,597,797 B1 * 7/2003 Betts ..... H04R 1/345 181/155
7,162,930 B2 * 1/2007 Hashimoto ..... G01F 1/662 73/861.25
8,496,358 B2 * 7/2013 McEntee ..... G02B 5/09 362/297
9,883,283 B2 * 1/2018 Kim ..... H04R 1/345
(Continued)

FOREIGN PATENT DOCUMENTS

CA 2157518 * 4/1997 ..... H04R 1/02
FR 2826827 A1 * 1/2003 ..... H04R 1/288
(Continued)

*Primary Examiner* — Oyesola C Ojo
(74) *Attorney, Agent, or Firm* — Device Patent LLC

(57) ABSTRACT

The article of invention is referred herein as a prime polygon reflector. In its various forms it is a device of predetermined geometric shape with aspects and scalable dimensions derived from a prime number and its mathematical square root. Geometric shapes based on the prime polygon have reflective surfaces that cause multiple internal reflections of incident waveform energy. When used in conjunction with absorptive media, coatings, or linings, the waveform energy is forced to pass through absorptive media multiple times, thereby increasing effectiveness of the media, coating, or lining. Prime polygon reflectors as disclosed herein produce waveform reflections that are non-inverted by causing an even number of internal reflections. Applications include but are not limited to acoustic, solar, and radar energy absorption.

22 Claims, 18 Drawing Sheets

(56) References Cited

U.S. PATENT DOCUMENTS

| | | | | |
|---|---|---|---|---|
| 2005/0219845 | A1* | 10/2005 | Cutler | G02B 6/0096<br>362/261 |
| 2016/0227315 | A1* | 8/2016 | Kim | H04R 1/288 |
| 2017/0006376 | A1* | 1/2017 | Tan | H04R 1/345 |

FOREIGN PATENT DOCUMENTS

| | | | | | |
|---|---|---|---|---|---|
| JP | 61100099 | A | * | 5/1986 | H04R 1/02 |
| JP | 02212896 | A | * | 8/1990 | G10K 11/20 |
| JP | 05148919 | A | * | 6/1993 | G10K 11/16 |
| KR | 20060040888 | A | * | 5/2006 | H04R 1/02 |
| RU | 2154244 | | * | 8/2000 | F24J 2/42 |
| RU | 2154244 | C1 | * | 8/2000 | F24L 2/42 |

* cited by examiner

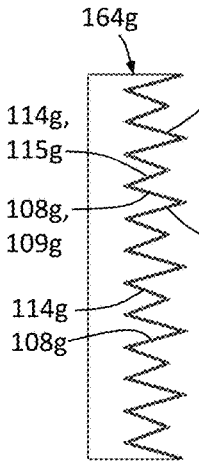
FIG. 20
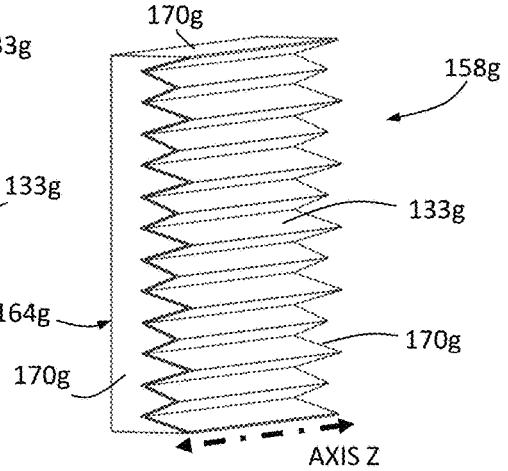
FIG. 21
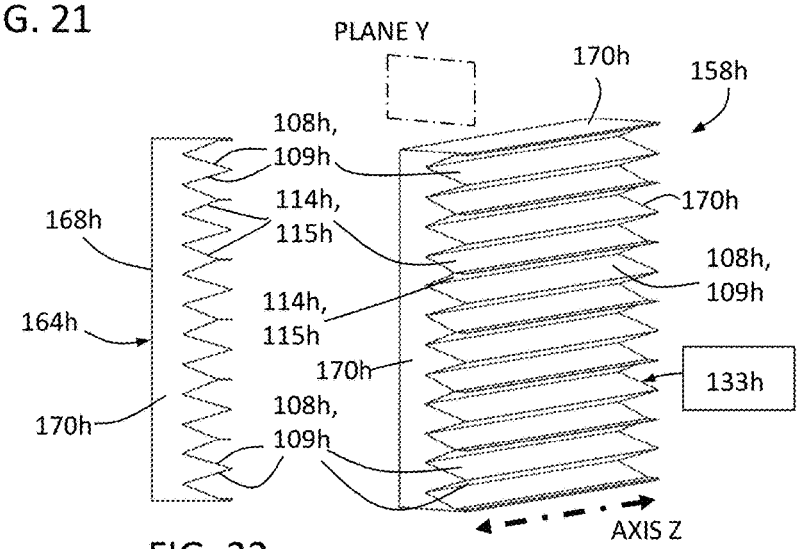
FIG. 22
FIG. 23
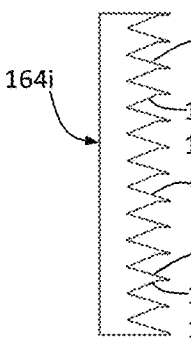
FIG. 24
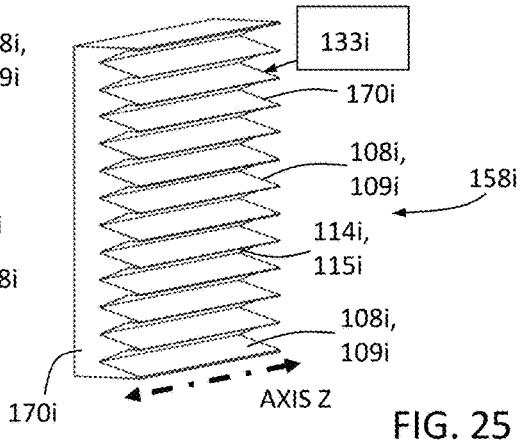
FIG. 25

PRIME POLYGON REFLECTORS AND METHODS OF USE

CROSS REFERENCE TO RELATED APPLICATIONS

This application is a Continuation-In-Part Patent Applications claiming priority to U.S. Non-Provisional patent application Ser. No. 16/188,575 filed on Nov. 13, 2018 which claims priority to Provisional Patent Application No. 62/707,726 filed Nov. 15, 2017, the entire disclosure of which is hereby incorporated by reference and relied upon.

BACKGROUND OF THE INVENTION

Field of the Invention

The invention relates generally to geometric energy absorption devices improving effectiveness of absorptive coatings or linings through multiple reflections and capable of producing non-inverted waveform reflections when exposed to parallel ray energy.

Description of Related Art

Two challenges when working with waveform energy are typically how to capture it or how to diminish it. When the waveform is a radar signal, the transmitted signal strikes an object and some of the energy is reflected which is recognized as an echo signal by the radar receiver. No prior art has been identified that provides reflected waveforms that are not inverted, nor reduced in amplitude through multiple absorptive passes.

When the application is a loudspeaker enclosure, many methods have been utilized to break up, distribute, disperse, or absorb unwanted reflection energy as seen in; JP61100099A by Yoshida, FR2673346 by Hausherr, CA2157518A1 by Blumenkranz, U.S. Pat. No. 4,474,258 by Westlund, 2013/0294638 by Huseby, and KR20060040888A by Kim. No prior art has been identified that diminishes reflected energy by providing multiple reflections and multiple passes through an absorptive media. Similarly, when the application is to capture wave energy from solar or other sources, many attempts have been made as illustrated in U.S. Pat. No. 4,960,468 by Sinton, U.S. Pat. No. 5,291,331 by Miano, and RU2154244 by Strebkov. Although the methods disclosed in this art represents some degree of advancement, improved methods are needed to more effectively diminish or capture waveform energy.

SUMMARY OF THE INVENTION

The article of invention referred to as a prime polygon reflector herein is a device of predetermined geometric shape with aspects and scalable dimensions derived from a prime number and its mathematical square root. Geometric shapes based on the prime polygon have reflective surfaces that cause multiple internal reflections of incident waveform energy. When used in conjunction with absorptive media, coatings, or linings, the waveform energy is forced to pass through the absorptive media multiple times, thereby increasing effectiveness of the media, coating, or lining. Prime polygon reflectors as disclosed herein produce reflected waveforms that are non-inverted by causing an even number of internal reflections.

In one form, one or more prime polygon reflectors are fixed to a structural framework of a device.

In one form, one or more prime polygon reflectors are formed within a structural framework of a device.

In one form, a prime polygon panel is constructed of materials having sufficient strength to contribute to or form primary structural support of a base structure such as a ship, building, aircraft, or other functional apparatus, with prime polygon reflectors tooled or formed into the panel to accept finish application of absorptive media.

In one form, a prime polygon panel thickness is selected to provide structural support to a device, therefore, wall thickness of a panel may be selected by the end user or designer based on the application, with prime polygon reflectors and absorptive media applied to the exposed panel surface.

In one form, an array of prime polygon reflectors includes flat surfaces in between the individual prime polygon reflectors. The flat surfaces may produce inverted waveform reflections. Non-inverted waveform energy is proportional to the percentage of surface area of the prime polygon reflectors versus the total surface area of the panel. Therefore, the overall percentage of non-inverted reflection energy can be increased in some embodiments by placing smaller prime polygon reflectors in the spaces in between and varying reflector sizes. Each diameter prime polygon reflector surface has specific frequency characteristics based on wavelength of incident energy, properties of reflector material, and properties of absorptive media. Multiple reflector sizes may be utilized within any individual panel. The end user or designer can select a combination of reflector sizes to achieve a desired frequency characteristic while maximizing the reflector surface area coverage of the panel.

In one form, if panels are made thin, they can easily be layered and inserted into a structural perimeter frame. This allows the designer to "tune" the absorption bandwidth while also being able to control exterior panel dimensions and structural properties.

In one form, a highly effective, bandwidth-tunable "STEALTH" panel is constructed from multi-layer panels and absorptive media filling the vacant spaces within each prime polygon reflector and between each sheet. Without any absorptive media, a highly sensitive, bandwidth-tunable antenna can be made, by electrically connecting the layers.

In one form, a prime polygon reflector is disclosed having a predetermined geometric shape.

In one form, a prime polygon reflector comprises a predetermined geometric sectional profile that is extended linearly along an axis Z.

In one form, a prime polygon reflector comprises a predetermined geometric sectional profile that is extended along axis Z which is curvilinear.

In one form, a prime polygon reflector is provided with one or more of a coated and a lined reflective surface.

In one form, a prime polygon reflector is configured to receive incident energy that passes through an absorptive media multiple times before being reflected back into the environment.

In one form, absorptive coating or lining is applied to internal surfaces of a prime polygon reflector whereby incident parallel ray energy entering the prime polygon reflector passes through the absorptive media multiple times.

In one form, absorptive media is in the form of but not limited to one or more of: a paint, a one part coating, a two part coating, an epoxy, caulk, sheet, urethane, and bonded film.

In one form, examples of absorptive media that may be applied for acoustic energy absorption includes but is not limited to one or more of: wool, acoustic foams such as SONEX® and multi-density products such as G&S SAE panels, blankets such as Sound Seal® DL100, and coatings such as Hy-Tech® SC #1000 and Noxudol® 3101. Market equivalents to these foams, blankets, and coatings may be used.

In one form, examples of absorptive media that may be applied for radar energy absorption includes but is not limited to one or more of: MWT® materials MF-500/501 urethane coating, bonded MAGRAM® film, and MAST Technologies® radar absorbing material (RAM) in the form of at least one of caulk, 2-part systems, bonded films or their equivalents.

In one form, a prime polygon reflector comprises an exposure face positioned generally orthogonal to the path of a generally parallel wave energy source.

In one form, the exposure face is a surface to be exposed by a predetermined parallel ray energy source.

In one form, the exposure face is generally planar of a predetermined length H.

In one form, the exposure face length H is determined by the application and is chosen to accommodate the wave energy source. For example, when used as a speaker cabinet, H is larger than the corresponding speaker driver diameter.

In one form, the exposure face is bounded by a first end and a second end and having a predetermined length H therebetween.

In one form, a prime polygon reflector comprises a first reflective face.

In one form, the first reflective face is angled generally $90-\alpha$ degrees from the exposure face.

In one form, the angle $\alpha$ has a nominal value approaching 16.917899 degrees.

In one form, the angle $\alpha$ is between 15.63673292 and 18 degrees.

In one form, the first reflective face has a length generally $\sqrt{3}$ times predetermined length H of the exposure face.

In one form, the first reflective face has a length generally $\sqrt{3}$ times predetermined length H of the exposure face with tolerance between $+0.15\sqrt{3}H$ and $-0.15\sqrt{3}H$ (+/−15%).

In one form, the first reflective face is bounded by a third end and a fourth end.

In one form, the second end of the exposure face intersects the third end of the first reflective face.

In one form, a prime polygon reflector comprises a second reflective face.

In one form, the second reflective face is bounded by a fifth end and a sixth end.

In one form, the fifth end of said second reflective face intersects said fourth end of said first reflective face.

In one form, the second reflective face is angled generally 90 degrees minus 3 times the angle $\alpha$ (also known as $\beta$) from the first reflective face.

In one form, a third reflective face is bounded by a seventh end and an eighth end.

In one form, the third reflective face extends generally orthogonal from the first end of the exposure face until intersection with the second reflective face.

In one form, the seventh end of a third reflective face is joined to the sixth end of the second reflective face.

In one form, the eighth end of the third reflective face is joined to the first end of the exposure face.

In one form, an exposure face, a first reflective face, a second reflective face, and a third reflective face are generally planar and positioned perpendicular to a common plane Y.

In one form, angle $\alpha$ is less than 90 degrees.

In one form, the first reflective face and the second reflective face define a reflection chamber therebetween.

In one form, the first reflective face, the second reflective face, and third reflective face define a reflection chamber therebetween.

In one form, a first reflective face and a second reflective face are arranged in a predetermined geometric orientation.

In one form, parallel ray energy entering a prime polygon reflector lined with absorptive media is reflected a plurality of times within the prime polygon reflector causing the parallel ray energy to be diminished with each pass through the absorptive media.

In one form, the absorptive media within a prime polygon reflector is in the form of a solar cell for absorption of solar energy.

In one form, parallel ray energy is directed generally perpendicular towards the exposure face.

In one form, a portion of the exposure face is removed from the point a distance H/6 from the second end of the exposure face to a point H/6.316011 from the first end of the exposure face.

In one form, exposing a prime polygon reflector to parallel ray energy at its exposure face provides four internal reflections of the parallel ray energy and produces equal total reflective path travel lengths at its points of convergence.

In one form, applying an absorptive coating or lining to interior surfaces of the prime polygon reflector causes incident parallel ray energy to pass through the absorptive media multiple times, increasing effectiveness of the absorptive media.

In one form, each ray at the envelope boundary is reflected an even number of times thereby keeping the parallel ray energy non-inverted in phase.

In one form, an absorptive lining is applied to interior reflective surfaces and incoming rays pass through an absorptive lining 8 times.

In one form, a total distance traveled by a first ray entering a prime polygon reflector is generally equal to a total distance traveled by a second ray thereby producing a reflection envelope boundary that is coherent in time at its point of convergence.

In one form, reflected energy from a ray enters and exits a prime polygon reflector at the same location.

In one form, rays entering a prime polygon reflector at various points along the reflector's exposure face experience 4 reflections (an even number) within the prime polygon reflector before exiting and do not exhibit 180 degree phase shift.

In one form, parallel ray energy reflected in a prime polygon reflector experiences a significantly reduced reflection energy that is coherent in time and non-inverted in phase.

The various embodiments of the disclosed prime polygon reflector have many applications, some of which are listed here. In one form, a prime polygon reflector is an acoustic structure that absorbs nearly all of the input energy.

In one form, a prime polygon reflector is configured as an effective loud speaker cabinet.

In one form, a prime polygon reflector is configured for use as ambient noise control.

In one form, a prime polygon reflector is configured as an RF absorber (i.e. radar) wherein the prime polygon reflector produces a reflection of minimal magnitude that is non-inverted.

In one form, a prime polygon reflector is configured as a solar absorber for effective absorption of incident energy as well as reclamation of initial reflected energy.

In one form, the basic shape of the prime polygon reflector can be one or more of arrayed, scaled, and dissected if limited by physical space.

In one form, an array of prime polygon reflectors comprises a plurality of prime polygon reflectors each having the same diameter across an exposure face.

In one form, an array of prime polygon reflectors comprises a plurality of prime polygon reflectors of two or more diameters across an exposure face.

In one form, one or more prime polygon reflectors are seated within a tapered bore extending at least partially into an array panel.

In one form, one or more prime polygon reflectors are seated within a straight bore extending at least partially into an array panel.

In one form, the thickness 'T' of an array panel may vary.

In one form, array panel thickness 'T' is greater than, less than, or equal to a particular prime polygon reflector depth R.

In one form, an array panel comprises a front face, a rear face, and one or more end faces.

In one form, bores for seating a prime polygon reflector do not extend through the entire thickness 'T' of an array panel.

In one form, an array panel comprises one or more fastening bores for securing a prime polygon reflector array in a predetermined position to a wall or other anchoring structure.

In one form, a non-polarized array of prime polygon reflectors is used as an ambient noise control panel in environments where frequency and location of noise vary.

In one form, an array panel having a structural base material is imprinted with varied sized prime polygon reflectors.

In one form, an array panel may include one or more of a first prime polygon reflector of a given diameter X, and any combination of one or more progressively smaller prime polygon reflectors.

In one form, combining a variety of prime polygon reflectors in an array panel minimizes the flat surfaces between adjacent prime polygon reflectors consequently reducing the incidence of producing inverted waveform reflections In one form, a noise control panel comprising a structural base material with varied sized prime polygon reflectors imprinted thereon are positioned with ends adjacent to each other forming enlarged noise control surfaces. Surfaces of the prime polygon reflectors are covered with a predetermined absorptive media.

In one form, an array panel is sufficiently thick to also serve as a structural panel material such as used in construction of ships, buildings, aircraft, and other structures.

In one form, an array panel is thin and thus unable to serve as a structural panel but may be fixed to a structure.

In one form, a multi-layer array panel comprises absorptive media disposed between one or more sheets.

In one form, materials of construction will vary depending on the application; however the materials need only to be efficient at reflecting the type of energy input, and capable of maintaining form, fit, and function under loading combinations of the application.

In one form, a prime polygon reflector is optimized based on the wavelengths of energy to be absorbed and the structural design requirements of the application.

In one form, a panel frame is utilized to couple a prime polygon reflector array to a structure such as a wall.

In one form, a panel frame comprises one or more end struts.

In one form, a panel frame comprises an intermediate strut.

In one form, an end strut comprises a base rib and panel rib extending from the base rib.

In one form, a prime polygon reflector array is configured as a vertically, horizontally, or angularly polarized prime polygon absorption panel for absorption of single wavelength radar.

In one form, disposed on a front side of a prime polygon reflector array and extending linearly from opposing sides is a plurality of vertically, horizontally, or angularly spaced first reflector faces on first reflector walls and a plurality of second reflective faces on second reflective walls.

In one form, a prime polygon reflector array comprises one or more first prime polygon reflectors of a given diameter X, and any combination of one or more progressively smaller prime polygon reflectors.

In one form, absorption characteristics are a function of prime polygon reflector diameter and energy wavelength. Varying size of individual reflectors within a single array provides an absorption bandwidth that is tunable by the designer.

In one form, a first reflective face and a second reflective face is covered by a radio frequency (RF)/radar absorptive media.

In one form, prime polygon geometric relationships are utilized to form reflective faces on an array panel.

In one form, a prime polygon reflector array is configured as a vertically, horizontally, or angularly polarized prime polygon reflector array for absorption of a pre-determined bandwidth radar.

In one form, a prime polygon reflector array is constructed from a plurality of individual array panels.

In one form, the plurality of individual array panels are sandwiched together and held as a prime polygon reflector array assembly.

In one form, a prime polygon reflector array assembly is at least partially held together by a non-reflective perimeter framing.

In one form, individual array panels comprise regions within the front face corresponding to a particular prime polygon geometric relationship used in that region.

In one form, a custom absorption spectra is created by varying the exposure face height H and layering a combination of prime polygon reflector array panels.

In one form, prime polygon reflectors are scribed into a prime polygon reflector array panel by stamping or die-forming into a thin reflective substrate.

In one form, prime polygon reflectors are tooled into an exterior surface of a thick array panel.

In one form, the reflection chambers defined herein are formed based on an exposure wall with exposure face thereon and reflective walls and reflective faces thereon. These exposure and reflective faces are positioned according to the predefined geometric polygon conditions and comprise coincident reference lines thereon. In various embodiments, portions of one or more of the exposure walls and exposure faces and reflective walls and reflective faces are truncated. At locations where this truncation occurs, the coincident reference lines for each of these faces remain and control the predefined reflection chamber geometry. Therefore, underlying an exposure face is an exposure reference, underlying a first reflective face is a first reflective reference, underlying a second reflective face is a second reflective reference, and underlying a third reflective face is a third reflective reference.

In one form, one or more reflective walls and/or exposure wall with associated faces thereon may be truncated for reasons such as space limitations, however the geometric relationship between the reflective faces and reflective walls as measured from inside the associated reflection chamber remain the same.

In one form, an exposure wall, a first reflective wall, a second reflective wall, and a third reflective wall with respective faces form a geometrically distinct polygon as measured from inside the associated reflection chamber. Despite portions of these faces and walls being truncated in some embodiments, a distinct intersection between reference lines associated with these exposure and reflective walls/faces remain.

In one form, absorptive media in a revolved geometry prime polygon reflector may be in the form of a solar collector such as solar film or coating.

BRIEF DESCRIPTION OF THE SEVERAL VIEWS OF THE DRAWINGS

These and other features and advantages of the present invention will become more readily appreciated when considered in connection with the following detailed description and appended drawings, wherein:

FIG. 20 is an end view of a vertically polarized prime polygon absorption panel for single wavelength radar according to one or more embodiments shown and described herein;

FIG. 21 is a perspective view of the vertically polarized prime polygon absorption panel of FIG. 20 wherein horizontal or angular polarization can be achieved by rotation of reflective faces or arrayed panels;

FIG. 22 is an end view of another vertically polarized prime polygon absorption panel for single wavelength radar with absorptive material removed according to one or more embodiments shown and described herein;

FIG. 23 is a perspective view of the vertically polarized prime polygon absorption panel of FIG. 22 with absorptive material removed according to one or more embodiments shown and described herein;

FIG. 24 is an end view of yet another vertically polarized prime polygon absorption panel for single wavelength radar with absorptive material removed according to one or more embodiments shown and described herein;

FIG. 25 is a perspective view of the vertically polarized prime polygon absorption panel of FIG. 24 with absorptive material removed according to one or more embodiments shown and described herein;

DETAILED DESCRIPTION OF SELECTED EMBODIMENTS OF THE INVENTION

Select embodiments of the invention will now be described with reference to the Figures. Like numerals indicate like or corresponding elements throughout the several views and wherein various embodiments are separated by letters (i.e. 100, 100B, 100C). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Figure 1:
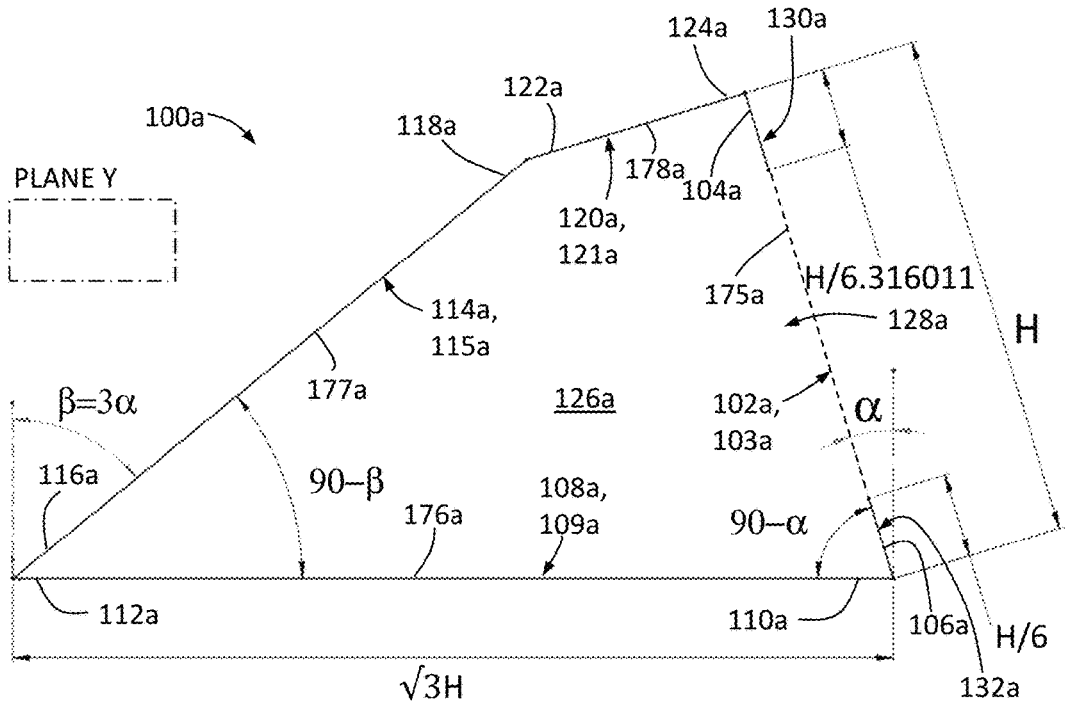
FIG. 1 depicts a geometric representation of various faces of a prime polygon reflector with underlying references illustrating defined geometric relationships according to one or more embodiments shown and described herein.

FIG. 1 illustrates prime polygon geometry 100*a* in a preferred embodiment of a prime polygon reflector. As illustrated, the geometric relationship is driven by a chosen height 'H' of an exposure face 102*a* as deemed useful for a given application. Geometric measurements reflect internal dimensions of reflection chamber 126*a* before application of any absorptive materials and are measured from the terminal ends of each face exposed in reflection chamber 126*a* where the faces geometrically intersect. Exposure face 102*a* comprises a first end 104*a* and a second end 106*a* and therefore is generally an internal measure between the exposure face 102*a* intersection with first reflective face 108*a* and third reflective face 120*a* of reflection chamber 126*a*.

In various embodiments, portions of one or more of the exposure walls and exposure faces and reflective walls and reflective faces are truncated. At locations where this truncation occurs, the coincident reference lines (in phantom) for each of these faces remain and control the predefined reflection chamber geometry. As illustrated in FIG. 1, underlying an exposure face 102*a* is an exposure reference 175*a*, underlying a first reflective face 108*a* is a first reflective reference 176*a*, underlying a second reflective face 114*a* is a second reflective reference 177*a*, and underlying a third reflective face 120*a* is a third reflective reference 178*a*.

Further in this embodiment, first reflective face 108*a* is angled from exposure face 102*a* by (90−α) degrees (generally 73.082101 degrees). As illustrated, α is generally equal to 16.917899 degrees. The internal measure of first reflective face 108*a* from intersection at third end 110*a* and fourth end 112*a* is nominally ($\sqrt{3}$ times H). As square root three is an exact mathematical value, and scaling factors close to this value are capable of producing reflection chambers with desirable properties, a tolerance of +/−15% square root three is applied, precluding competitive designs from using scaling factors close to square root three and arguing angular restrictions on alpha therefore do not apply.

Second reflective face 114*a* is angled from first reflective face 108*a* at intersection of fourth end 112*a* of first reflective face 108*a* and fifth end 116*a* of second reflective face 114*a* at an angle 90−β degrees (wherein β=3 times α). Third reflective face 120*a* extends from eighth end 124*a* generally orthogonal from first end 104*a* of exposure face 102*a*. The length of second reflective face 114*a*, and third reflective face 120*a* are determined by the intersection of these two faces at sixth end 118*a* of second reflective face 114*a* and seventh end 122*a* of third reflective face 120*a*. As illustrated, the exposure face 102*a*, and the first, second, and third reflective faces 108*a*, 114*a*, and 120*a* form a polygon.

The exposure face and each reflective face are disposed on a corresponding wall facing the reflection chamber. For example, exposure face 102*a* is disposed on exposure wall 103*a*, first reflective face 108*a* is disposed on first reflective wall 109*a*, second reflective face 114*a* is disposed on second reflective wall 115*a*, and third reflective face 120*a* is disposed on third reflective wall 121*a*. Each wall is manufactured of materials capable of reflecting an energy wave such as sound for example. In a preferred embodiment, walls are constructed of a wood material. In alternative embodiments, walls are constructed of polymers, composites, metals, or other materials sufficiently capable of reflecting energy waves and structurally capable of maintaining form, fit, and function under external physical loading combinations of the application.

In this embodiment, a window 128*a* is provided through the exposure face 102*a* of the prime polygon as illustrated using the dashed line. It is through window 128*a* that parallel wave energy enters and exits the prime polygon reflector. In this embodiment, window 128*a* is offset along exposure face 102*a* from third reflective face 120*a* by a distance generally H divided by 6.316011 and offset along exposure face 102*a* from first reflective face 108*a* by a distance generally H divided by 6. In this embodiment, window 128*a* defines first exposure tab 130*a* and second exposure tab 132*a*.

Figure 2:
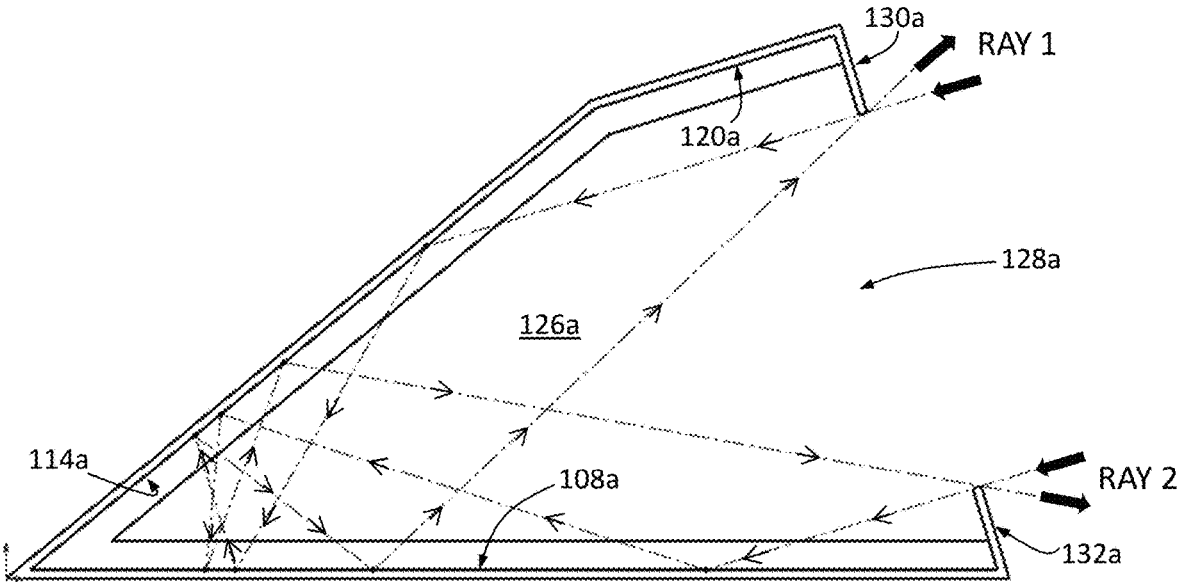
FIG. 2 depicts a section view of various faces of a prime polygon reflector illustrating the path of parallel ray energy entering and exiting a prime polygon reflector at two different locations according to one or more embodiments shown and described herein. In this embodiment, each ray exits the prime polygon reflector at their respective entrance points.

FIG. 2 illustrates parallel ray energy entering and exiting a preferred embodiment of a prime polygon reflector at two locations. The total distance traveled by RAY 1 is equal to the total distance traveled by RAY 2 producing a reflection envelope boundary that is coherent in time by virtue of equal length travel paths. Note also in this embodiment, the reflected energy from RAY 1 exits the prime polygon reflector at the same location as it entered. Similarly the reflected energy from RAY 2 exits the prime polygon reflector at the same location that it entered. RAYs 1 and 2 each experience 4 reflections (an even number) within the prime polygon reflector and therefore do not exhibit a 180 degree phase shift. Parallel ray energy entering the prime polygon reflector in between RAY 1 and RAY 2 also experiences 4 reflections before exiting. Applying an absorptive coating or lining to interior surfaces of the prime polygon reflector causes incident parallel ray energy to pass through the absorptive media multiple times, increasing effectiveness of the absorptive media.

The inventor has completed extensive experimentation to determine a range of values for α that creates a reflection chamber envelope producing multiple even number reflections without the 180 degree phase shift of a normal reflector. Based on these experiments, best results are achieved when α ranges between 15.63673292 and 18.0 degrees.

Figure 3:
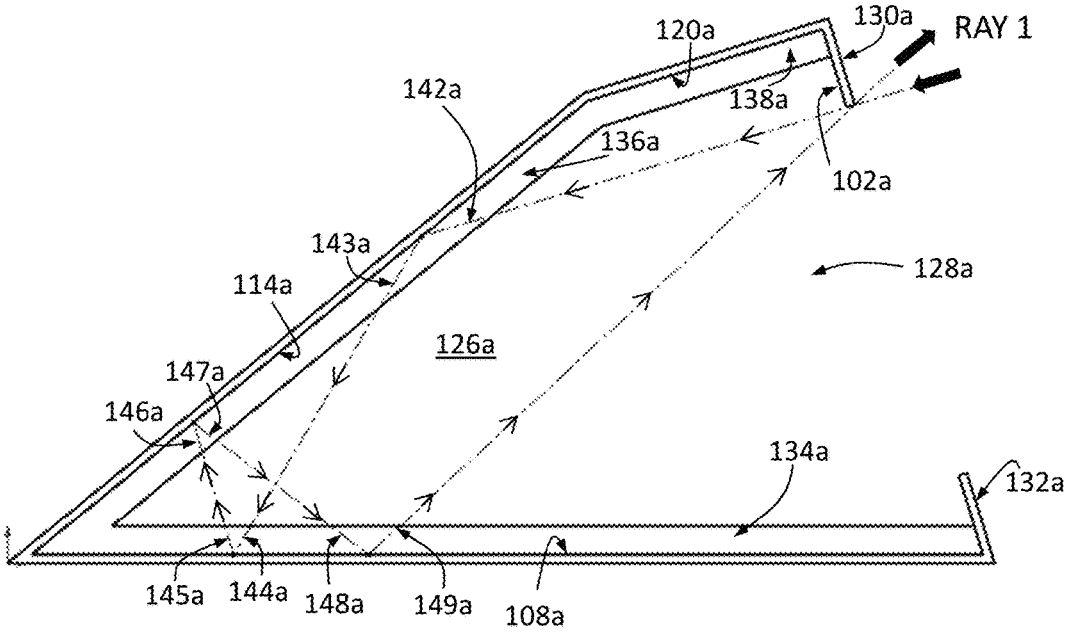
FIG. 3 depicts a section view of various faces of a prime polygon reflector with absorptive lining and further illustrates the path of a single ray entering through a window near a first end of an exposure face according to one or more embodiments shown and described herein.
Figure 4:
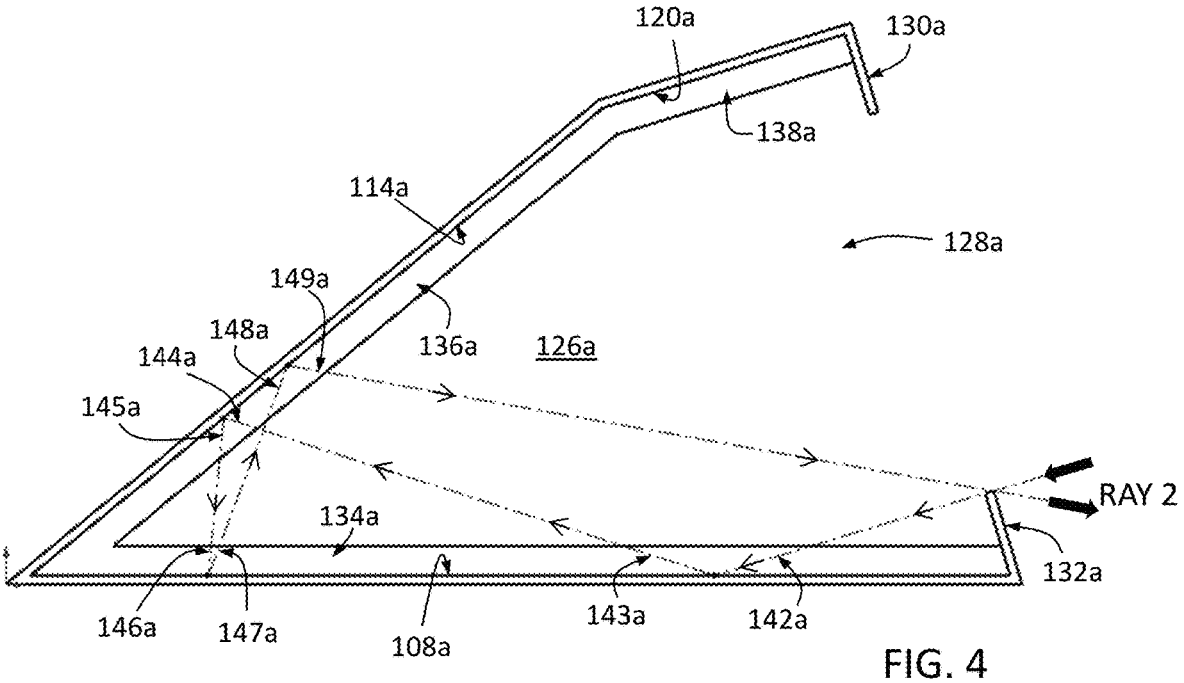
FIG. 4 depicts a section view of various faces of a prime polygon reflector with absorptive lining and further illustrates the path of a second single ray entering through a window near a second end of an exposure face according to one or more embodiments shown and described herein.

FIGS. 3 and 4 illustrate a prime polygon reflector internally lined with absorptive media and the path of two sample rays (RAY1 and RAY2) as they are reflected in the reflection chamber 126*a* and travel through the absorptive media. In preferred embodiments, the absorptive media covers first reflective face 108*a*, second reflective face 114*a*, and third reflective face 120*a* inside reflection chamber 126*a*. In some embodiments, absorptive media may also cover portions of first exposure tab 130*a* and second exposure tab 132*a* each facing reflection chamber 126*a*. The absorptive media may assume a variety of forms suitable for the application. For example, for some applications the absorptive media may be in the form of sections of flat panels that are sized to a corresponding reflective face. In other applications, the absorptive media may be molded to fit a reflection chamber of a particular size or shape. In other applications, the absorptive media may be sprayed, brushed, dipped or poured directly on one or more reflective faces or onto a mold surface sized and shaped for later application against a reflective face. Many of these techniques will produce completely filled profiles of absorptive media with a smooth or other desired surface.

FIG. 3 illustrates full travel path of incident RAY 1, and FIG. 4 shows the full travel path of incident RAY 2. In each of FIGS. 3 and 4, a sequential number is assigned each time the incident energy ray passes through the absorptive media lining. As indicated in FIGS. 3 and 4, each incident energy ray passes through the absorptive media a total of 8 times. For example, the first absorptive pass occurs at 142*a*, the second absorptive pass occurs at 143*a*, the third absorptive pass occurs at 144*a*, the fourth absorptive pass occurs at 145*a*, the fifth absorptive pass occurs at 146*a*, the sixth absorptive pass occurs at 147*a*, the seventh absorptive pass occurs at 148*a*, and the eighth absorptive pass occurs at 149*a*. Incident energy rays entering the prime polygon reflector between the entrance points of RAY 1 and RAY 2 (i.e. through window 128*a*) also pass through the absorptive media nominally 8 times. Assuming a structure forming the shape of the prime polygon reflector is of adequate structural integrity to retain its shape and of suitable material to reflect incident energy perfectly, effectiveness of the absorptive media is increased by a nominal factor of 8 by virtue of the incident energy being reflected to pass through the absorptive media multiple times. As an example, an absorptive media capable of 3 dB absorption at each pass would approach 8×3 dB=24 dB (99.6%) energy absorption when applied to the interior surfaces of a prime polygon reflector as disclosed herein. The remaining 0.4% rejected energy, having been reflected an even number of 4 times would not exhibit the 180 degree phase shift normally associated with an incident, normal reflection. As a point of comparison, radar absorbing coatings such as MWT Materials MF-500/501 or MAST Technologies MAGRAM publish absorption values of 4-20 db for X-band radar applications (8-12 GHz) at applied thickness of 1-3 mm.

Figure 5:
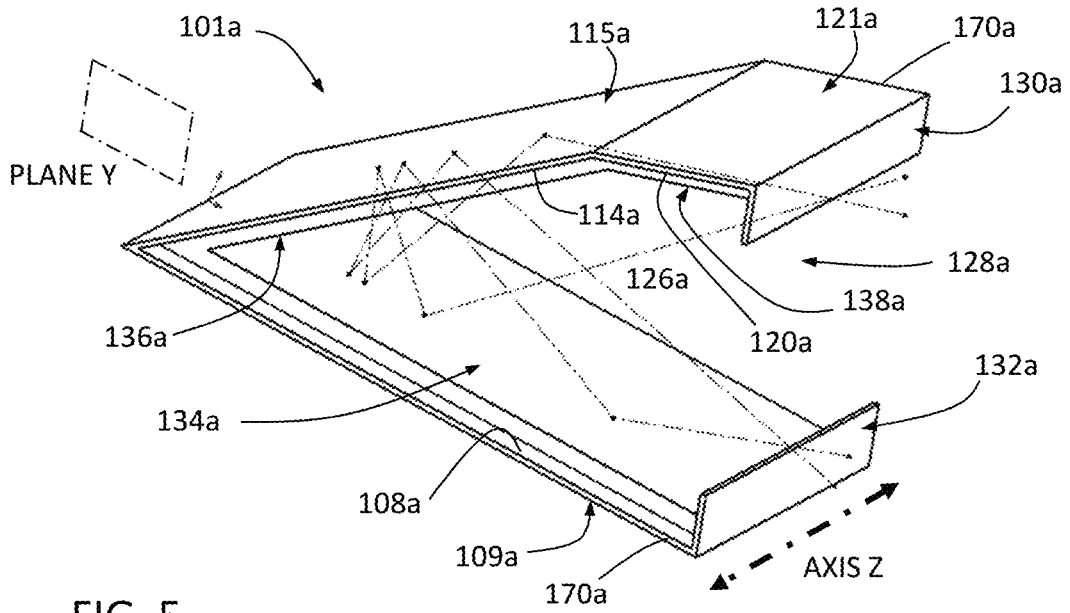
FIG. 5 depicts a partial perspective view of a prime polygon reflector in an elongate configuration illustrating two samples of ray energy being reflected and passing through an absorptive media according to one or more embodiments shown and described herein.

FIG. 5 illustrates a perspective view of a prime polygon reflector in an elongated configuration with two samples of ray energy reflected and passing through an absorptive media. Identified in the drawing is first reflective wall 109*a* with first reflective face 108*a* thereon and covered by first absorptive media 134*a*. Second reflective wall 115*a* has second reflective face 114*a* thereon which is covered by second absorptive media 136*a*. Third reflective wall 121*a* has third reflective face 120*a* thereon and is covered by third absorptive media 138*a*. Window 128*a* extends through the corresponding exposure wall and defines first exposure tab 130*a* and second exposure tab 132*a*. In this embodiment, each of the exposure and reflective walls are extended along Axis Z which here is illustrated as straight. In alternative embodiments, Axis Z may be curvilinear resulting in non-planar reflection chamber surfaces.

Figure 6:
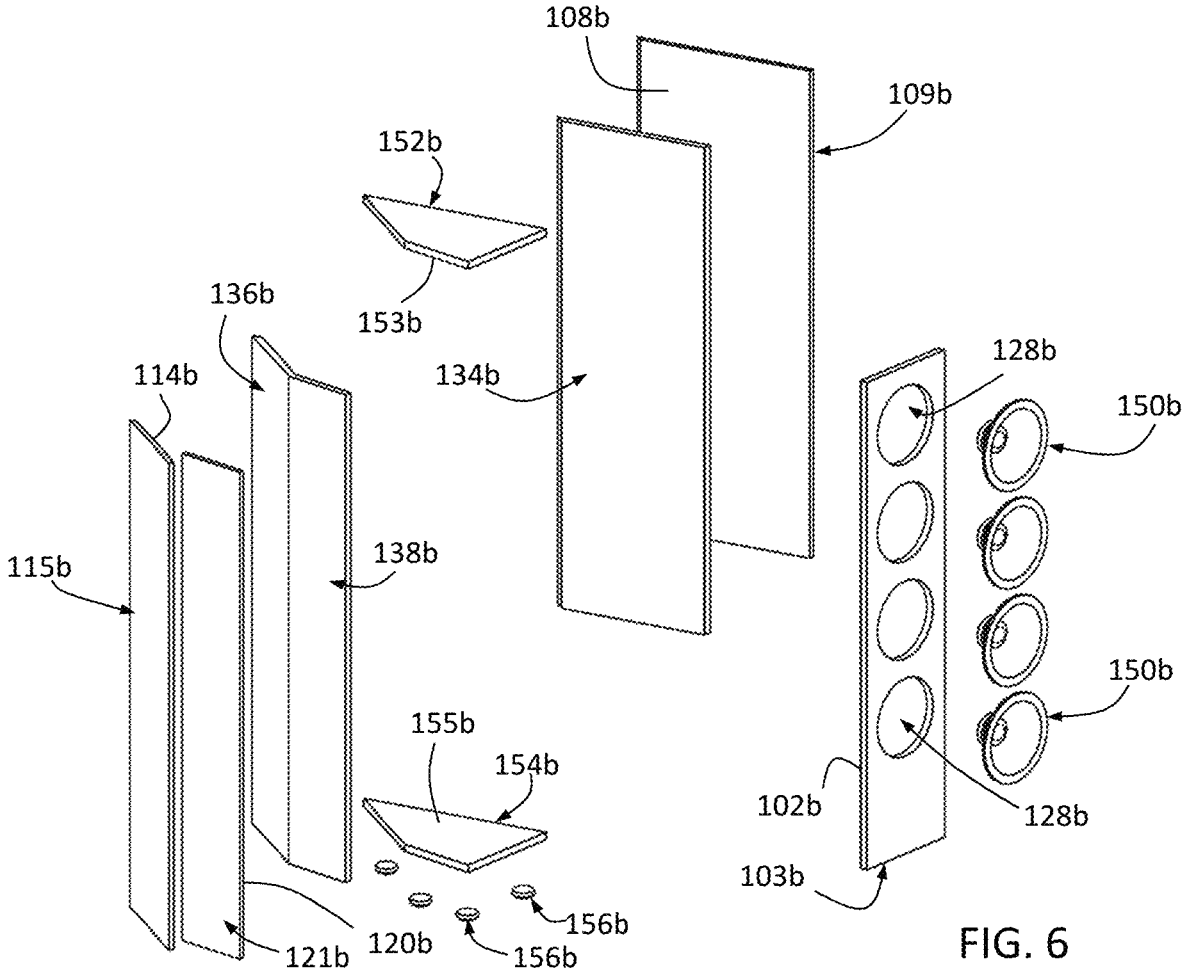
FIG. 6 depicts an exploded view of a prime polygon reflector in the form of an audio speaker according to one or more embodiments shown and described herein.
Figure 7A:
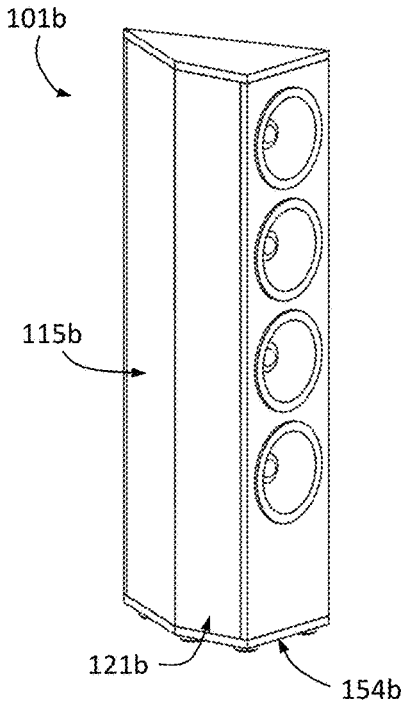
FIG. 7*a* depicts first side perspective view of the audio speaker of FIG. 6 according to one or more embodiments shown and described herein.
Figure 7B:
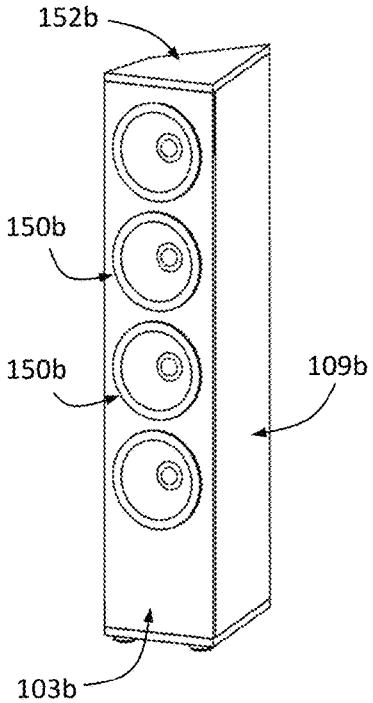
FIG. 7*b* depicts a second side perspective view of the audio speaker of FIG. 6 according to one or more embodiments shown and described herein.
Figure 7C:
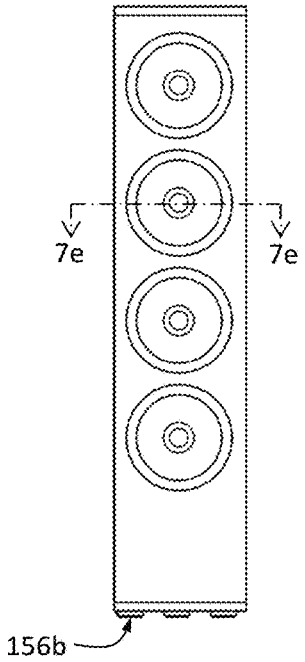
FIG. 7*c* depicts a front view of the audio speaker of FIG. 6 according to one or more embodiments shown and described herein.
Figure 7D:
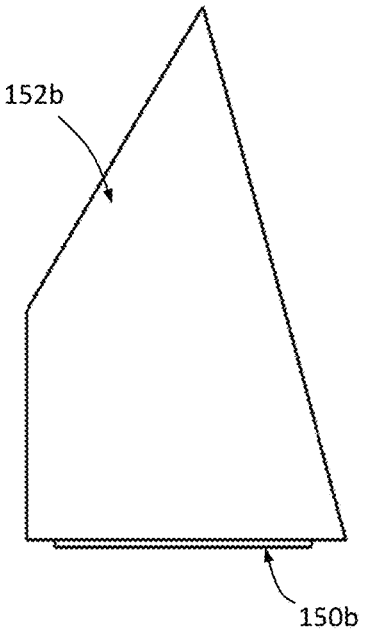
FIG. 7*d* depicts a top view of the audio speaker of FIG. 6 according to one or more embodiments shown and described herein.
Figure 7E:
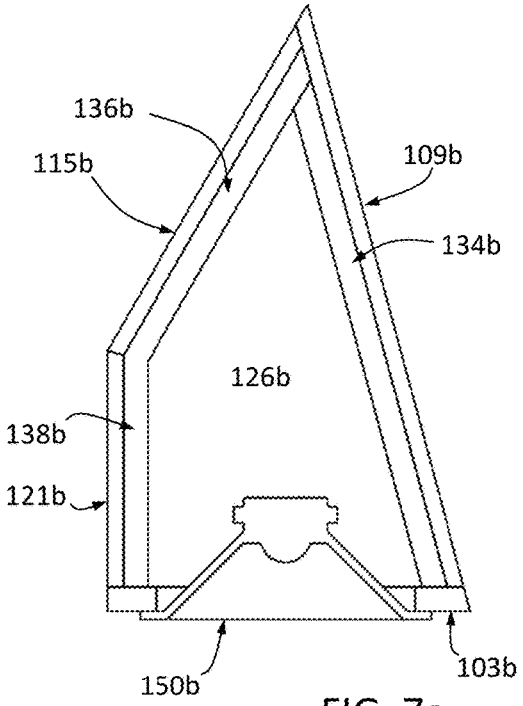
FIG. 7*e* depicts a cross-sectional view of the audio speaker of FIG. 6 according to one or more embodiments shown and described herein.

FIGS. 6 and 7*a*-7*e* illustrate use of an embodiment of a prime polygon reflector arrayed linearly and configured as a loud speaker cabinet. FIG. 6 is an exploded view of the speaker illustrated in FIG. 7*a*-7*c*. FIGS. 7*d* (top view) and 7*e* (cross-sectional) are views illustrating the familiar prime polygon geometry. As illustrated in FIG. 6, this reflector comprises an exposure wall 103*b* with exposure face 102*b* thereon facing a reflection chamber. Windows 128*b* extend through exposure wall 103*b*. In this embodiment, window 128*b* is generally round and is spaced from first reflective wall 109*b* and third reflective wall 121*b* according to the previously defined geometric conditions H/6 and H/6.316011. Optimum placement is achieved when the effective cone diameter or characteristic dimension of the loudspeaker driver coincides with the prime polygon points of convergence. When this condition exists, energy input along the driver axis is forced through absorptive media a minimum of eight times before any reflective path could allow energy to escape the cabinet by exiting through the driver. Audio speaker 150*b* is mounted over each window 128*b* using fasteners. Third reflective wall 121*b*, second reflective wall 115*b*, and first reflective wall 109*b* with corresponding reflective faces thereon are sized and positioned to create a reflection chamber 126*b* therebetween. In this embodiment, each of the first, second, and third reflective faces 108*b*, 114*b* and 120*b* is covered by a respective first absorptive media 134*b*, second absorptive media 136*b*, and third absorptive media 138*b*. A first cap wall 152*b* (with first cap face 153*b* thereon) and a second cap wall 154*b* (with second cap face 155*b* thereon) enclose the ends of reflection chamber 126*b* and may also be covered in absorptive media. One or more feet are mounted to a bottom surface of second cap wall 154*b* to position the speaker cabinet on the floor. Fasteners, adhesives, tapes, dowels, and other methods may be used to join each reflective wall to form the speaker box and to hold the respective absorptive media to the corresponding reflective face. In some embodiments, faces directed toward reflection chamber 126*b* of first cap wall 152*b*, second cap wall 154*b*, and exposure wall 103*b* may also be covered with absorptive media. Operation of a prime polygon reflector is primarily dependent on the positioning of the exposure faces and reflective faces with respect to each other. Therefore, substantial changes to surfaces outside the reflection chamber may be done in various applications for cosmetic reasons thereby changing the outward appearance of the prime polygon reflector without affecting performance.

Figure 8:
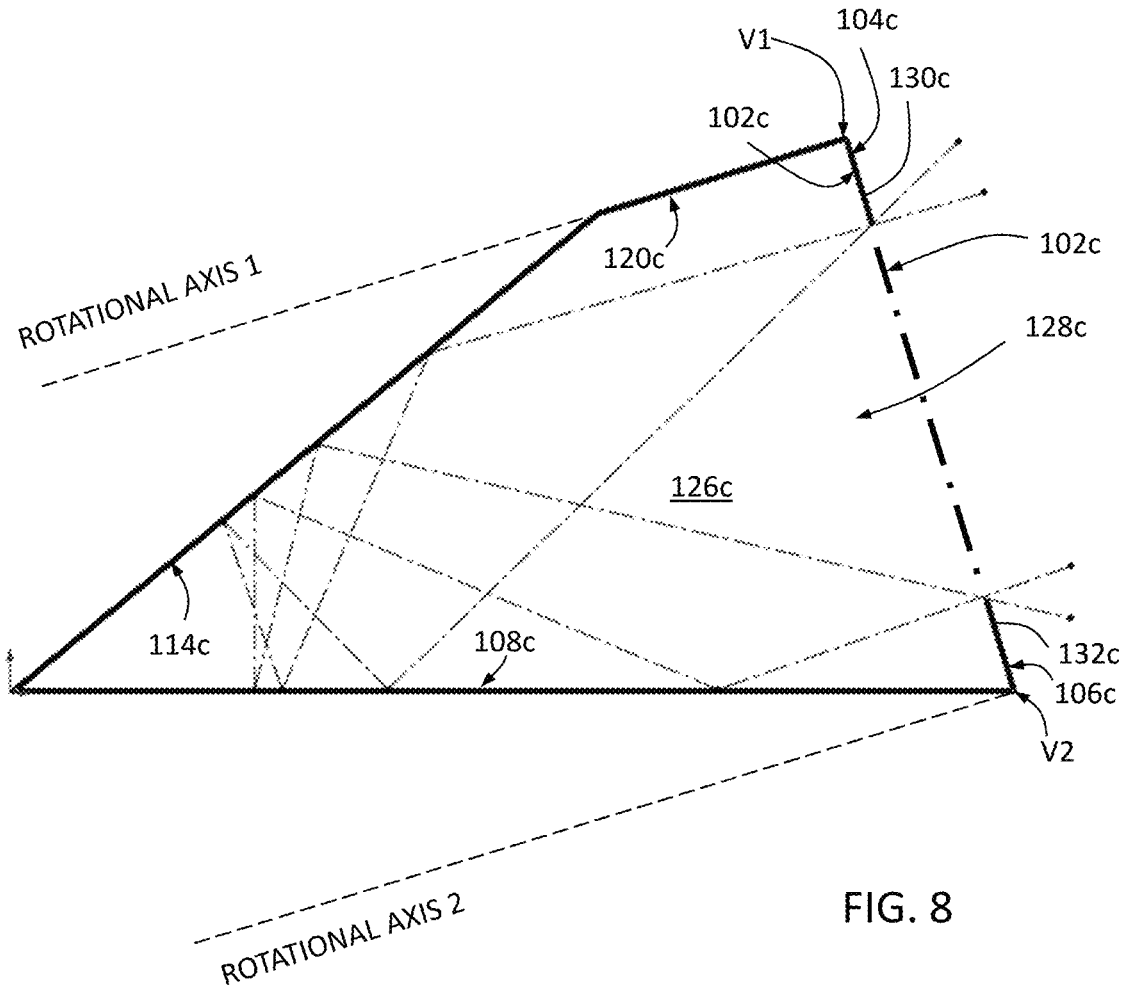
FIG. 8 depicts Rotational Axis 1 and Rotational Axis 2 around which the prime polygon geometry may be rotated for creation of two types of revolved (non-polarized) prime polygon reflectors according to one or more embodiments shown and described herein.
Figure 9A:
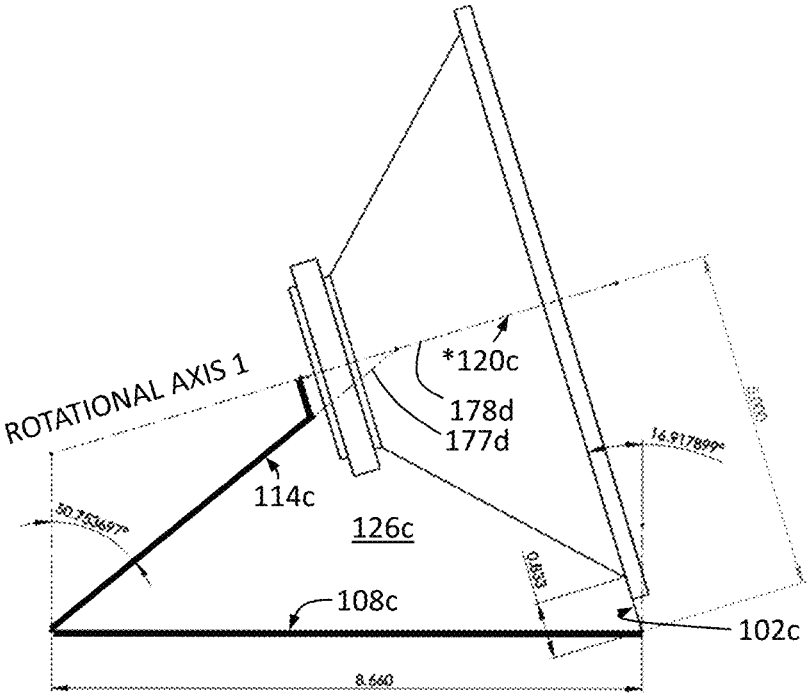
FIG. 9*a* depicts a line drawing of prime polygon reflector geometry for rotation about Rotational Axis 1 in a speaker box application according to one or more embodiments shown and described herein.
Figure 10A:
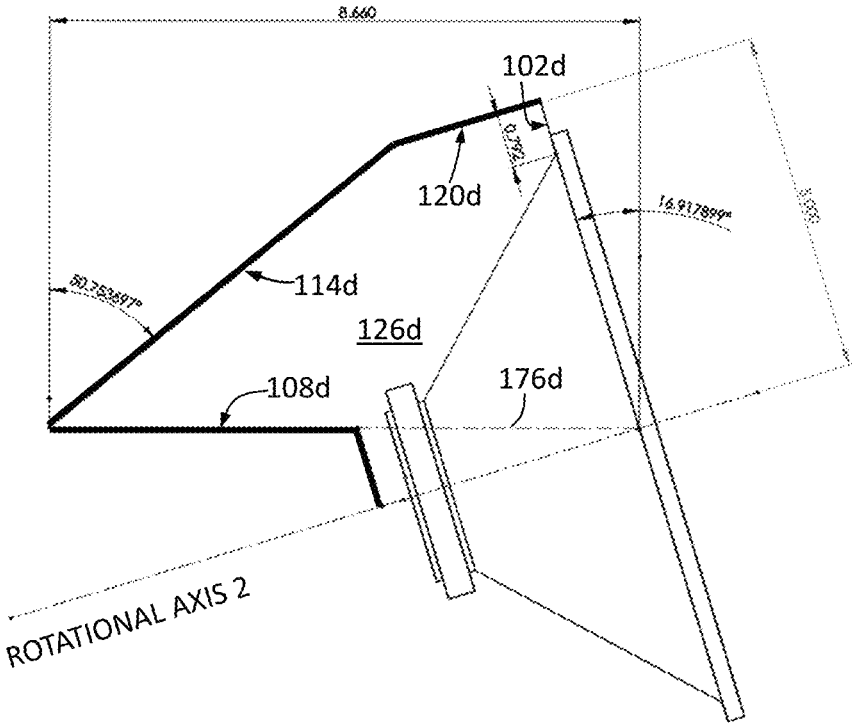
FIG. 10*a* depicts a line drawing of prime polygon reflector geometry for rotation about rotational axis 2 in a speaker box application according to one or more embodiments shown and described herein.
Figure 9B:
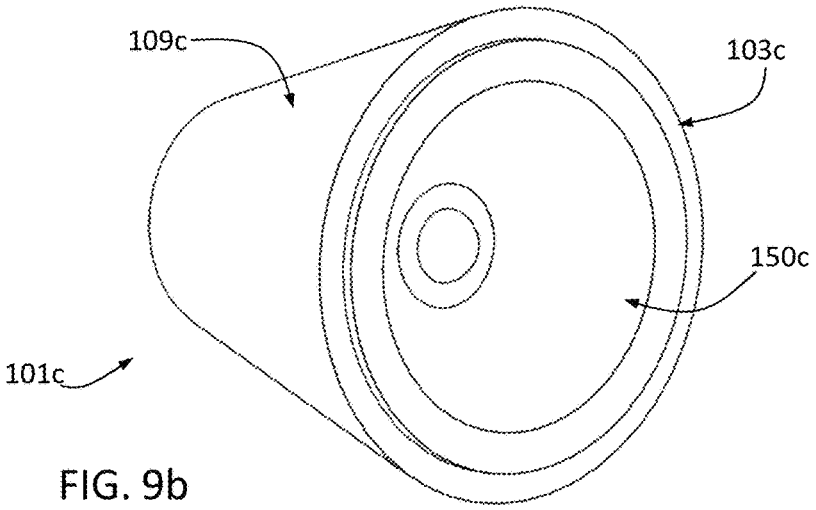
FIG. 9*b* depicts a front perspective view of a prime polygon reflector with speaker created from rotation about rotation axis 1 as illustrated in FIG. 9*a* according to one or more embodiments shown and described herein.
Figure 9C:
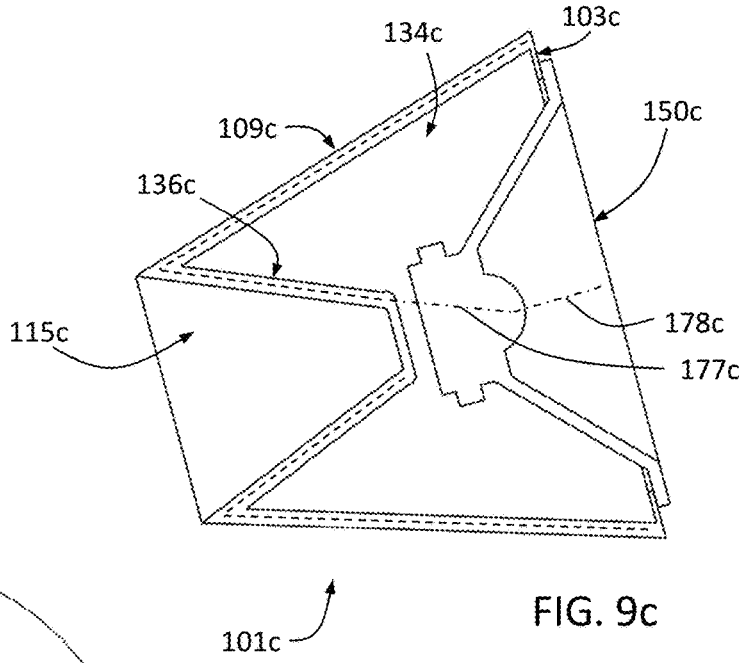
FIG. 9*c* depicts a cross-sectional view of the prime polygon reflector with loud speaker driver depicted in FIG. 9*b* with a second reflective reference and third reflective reference representing some of the truncated portions according to one or more embodiments shown and described herein.
Figure 9D:
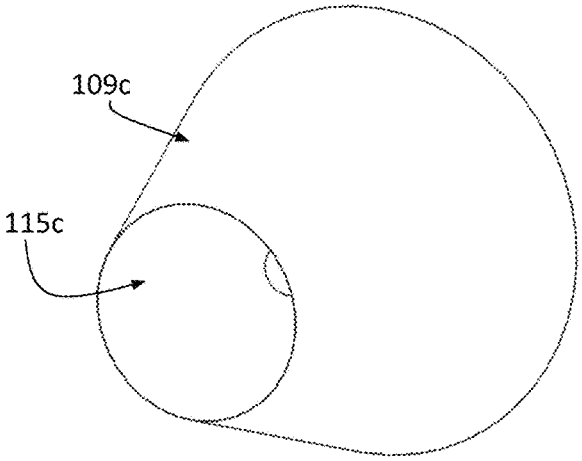
FIG. 9*d* depicts a rear perspective view of the prime polygon reflector depicted in FIG. 9*b* according to one or more embodiments shown and described herein.
Figure 9E:
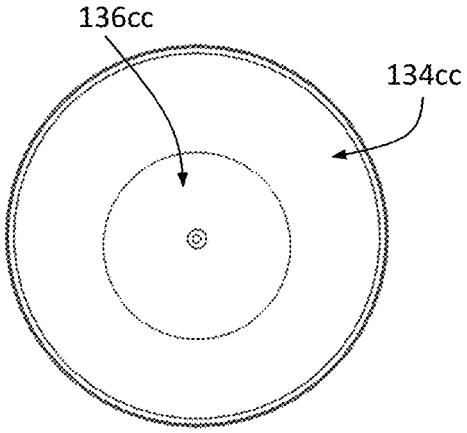
FIG. 9*e* depicts a front view of a revolved prime polygon reflector created by rotation about Rotational Axis 1 according to one or more embodiments shown and described herein.
Figure 9F:
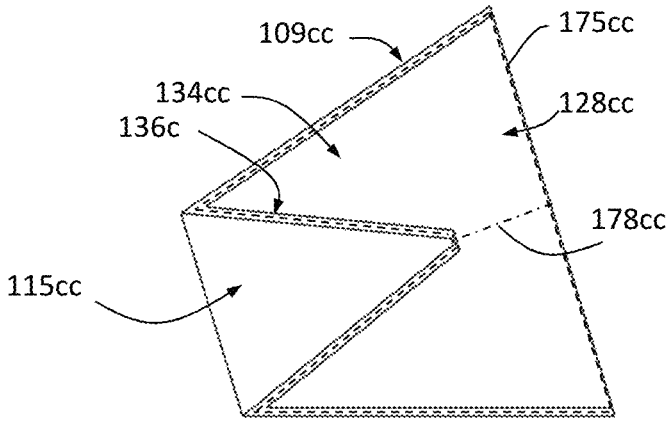
FIG. 9*f* depicts a cross-sectional view of the revolved prime polygon reflector of FIG. 9*e* according to one or more embodiments shown and described herein.
Figure 10B:
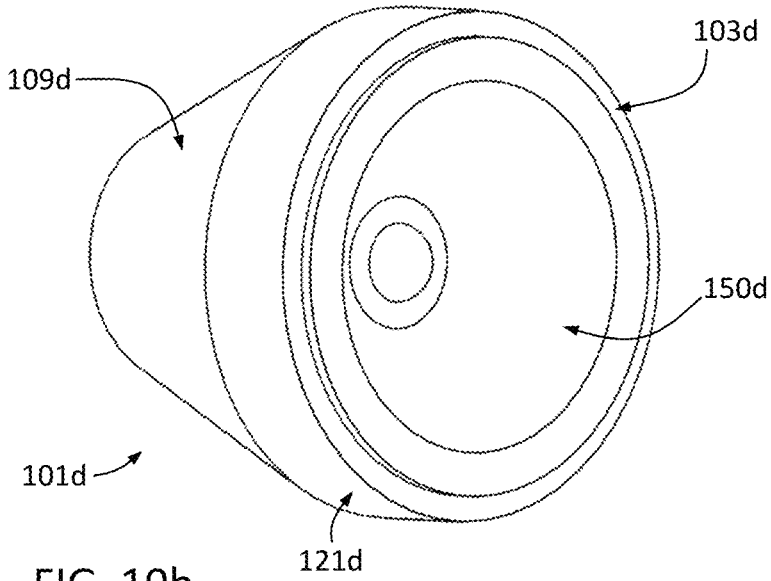
FIG. 10*b* depicts a front perspective view of a prime polygon reflector with speaker created from rotation about rotation axis 2 as illustrated in FIG. 10*a* according to one or more embodiments shown and described herein.
Figure 10C:
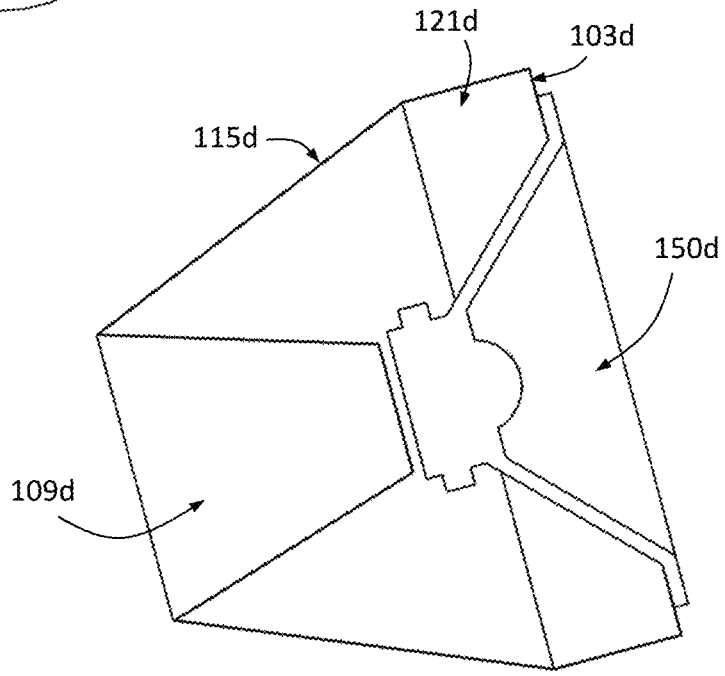
FIG. 10*c* depicts a cross-sectional view of the prime polygon reflector with loud speaker driver depicted in FIG. 10*b* according to one or more embodiments shown and described herein.
Figure 10D:
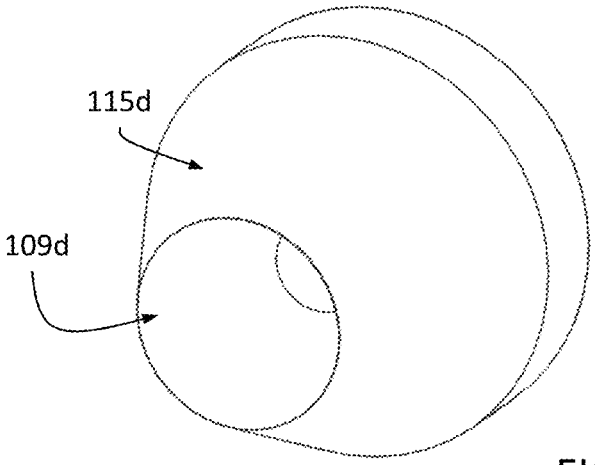
FIG. 10*d* depicts a rear perspective view of the prime polygon reflector depicted in FIG. 10*b* according to one or more embodiments shown and described herein.
Figure 10E:
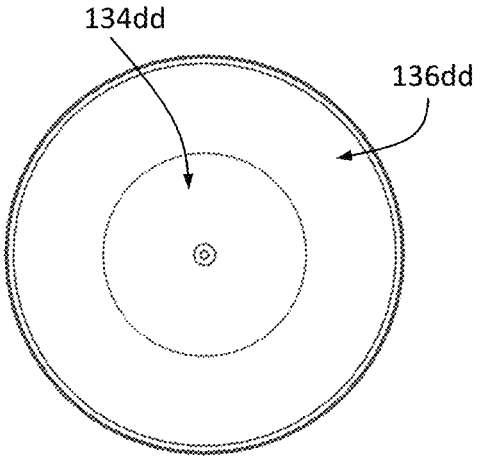
FIG. 10*e* depicts a front view of a revolved non-polarized prime polygon reflector created by rotation about Rotational Axis 2 according to one or more embodiments shown and described herein.
Figure 10F:
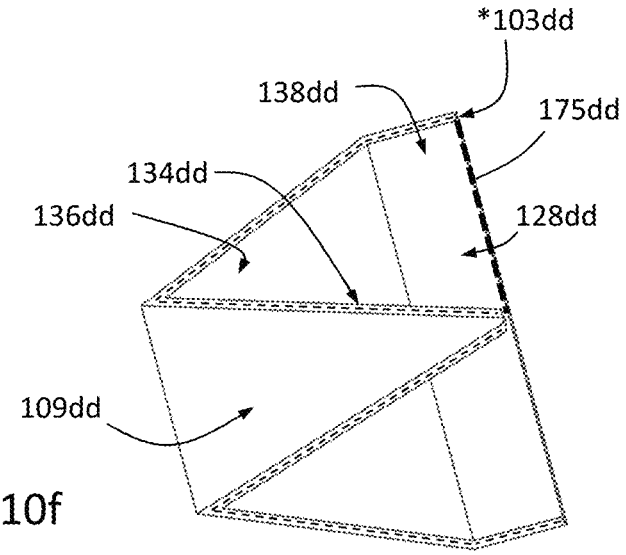
FIG. 10*f* depicts a cross-sectional view of the revolved prime polygon reflector of FIG. 10*e* according to one or more embodiments shown and described herein.

FIG. 8 illustrates prime polygon reflector geometry and introduces Rotational Axis 1 which is positioned orthogonal to exposure face 102*c* at V1 located at first end 104*c* of exposure face 102*c* and extends coincident with third reflective face 120*c*. FIG. 8 also introduces Rotational Axis 2 which is also orthogonal to exposure face 102*c* at V2 located at second end 106*c* of exposure face 102*c*. Therefore, Rotational Axis 2 is parallel to third reflective face 120*c* and Rotational Axis 1 and Rotational Axis 2 are spaced by a distance H. When the prime polygon geometry is revolved about Rotation Axis 1 or Rotational Axis 2, revolved configurations of the prime polygon reflector are produced. For example, FIG. 9*a* illustrates one embodiment of the geometry that may be used to create a revolved speaker box when revolved about Rotational Axis 1. FIGS. 9*b*, 9*c*, and 9*d* illustrate various views of a speaker box comprising this revolved geometry. As illustrated in the cross-sectional view of FIG. 9*c*, portions of the geometry have been truncated in this embodiment thereby minimizing direct reflective surface area. As another example, FIG. 10*a* illustrates an embodiment of the geometry that may be used to create a revolved speaker box when revolved about Rotational Axis 2. Note in these examples, the exposure face has a length H (diameter in this case) of 10. FIGS. 10*b*, 10*c*, and 10*d* illustrate various views of a speaker box comprising this revolved geometry. As illustrated in the cross-sectional view of FIG. 10*c*, portions of the geometry have been truncated in this embodiment. Note that prime polygon reflectors formed by rotation about Rotational Axis 1 or Rotational Axis 2 results in consequent conical shape of the first reflective face and the second reflective face.

The geometric shapes illustrated in FIGS. 9*b* through 10*g* lend themselves to existing manufacturing, presswork, and molding operations, allowing circular exposure faces to be repeated and arrayed and therefore facilitating the absorptive gains of the lined prime polygon reflector to be applied to large surface areas.

Figure 9G:
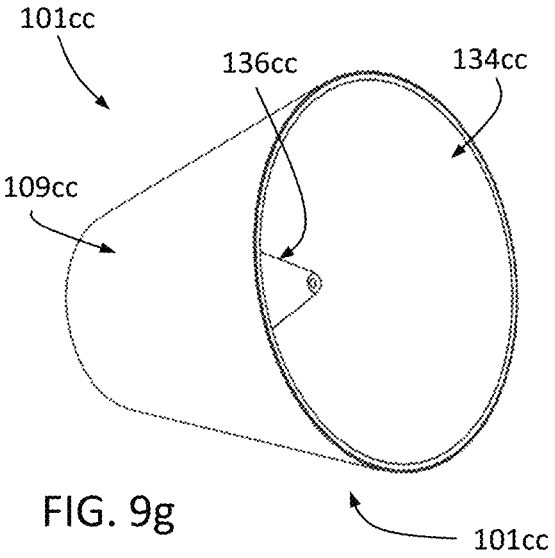
FIG. 9*g* depicts a front perspective view of the revolved prime polygon reflector of FIG. 9*e* according to one or more embodiments shown and described herein.
Figure 10G:
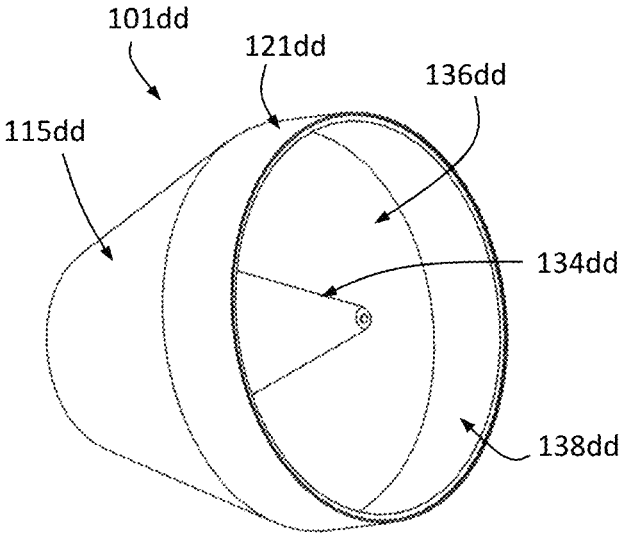
FIG. 10*g* depicts a front perspective view of the revolved prime polygon reflector of FIG. 10*e* according to one or more embodiments shown and described herein.
Figure 11A:
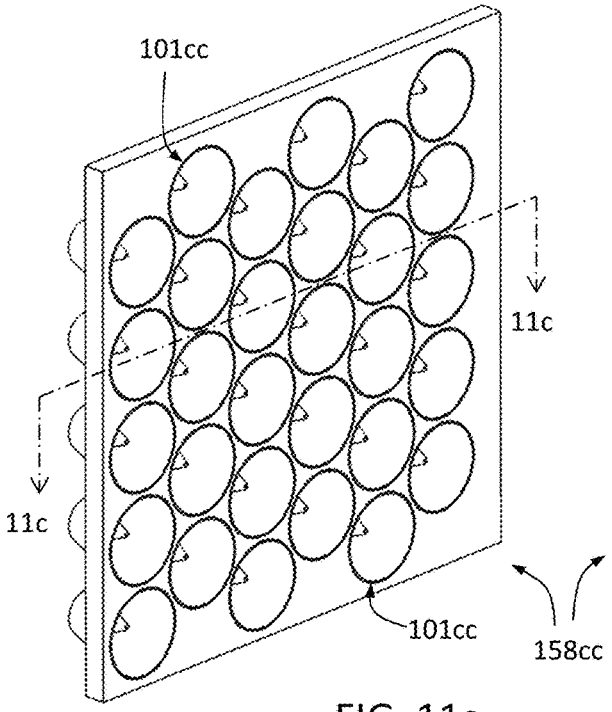
FIG. 11*a* depicts a front perspective view of an arrayed panel of prime polygon reflectors of FIG. 9*g* according to one or more embodiments shown and described herein.
Figure 11B:
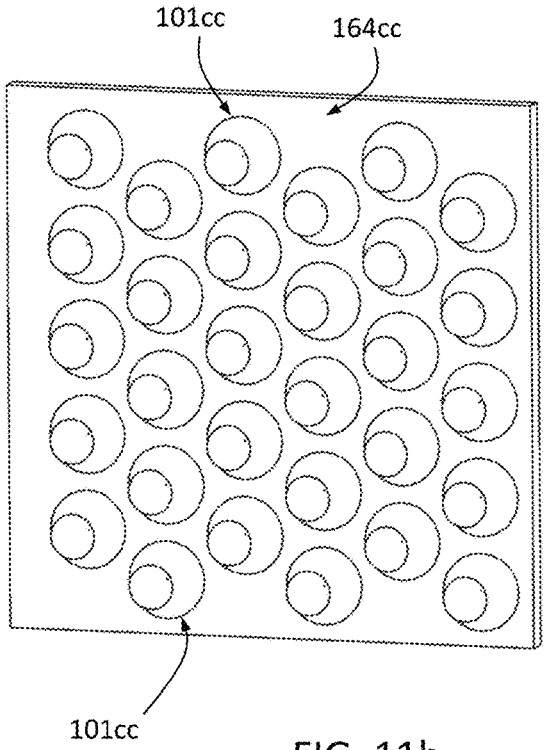
FIG. 11*b* depicts a rear perspective view of a an arrayed panel of prime polygon reflectors of FIG. 9*g* according to one or more embodiments shown and described herein.
Figure 11C:
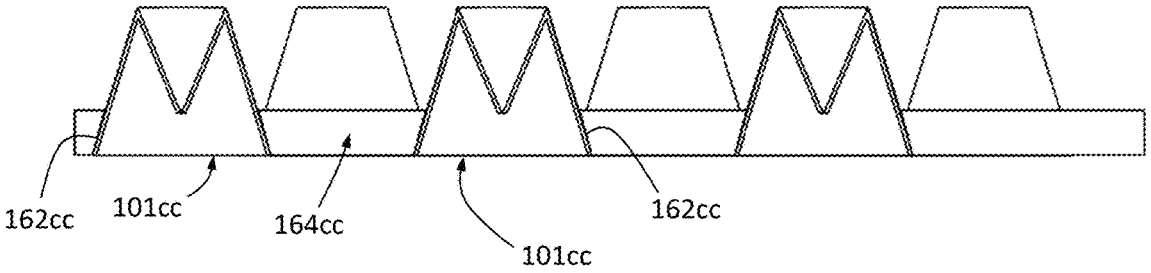
FIG. 11*c* depicts a cross sectional view of the arrayed panel of prime polygon reflectors of FIG. 11*a* according to one or more embodiments shown and described herein.
Figure 12A:
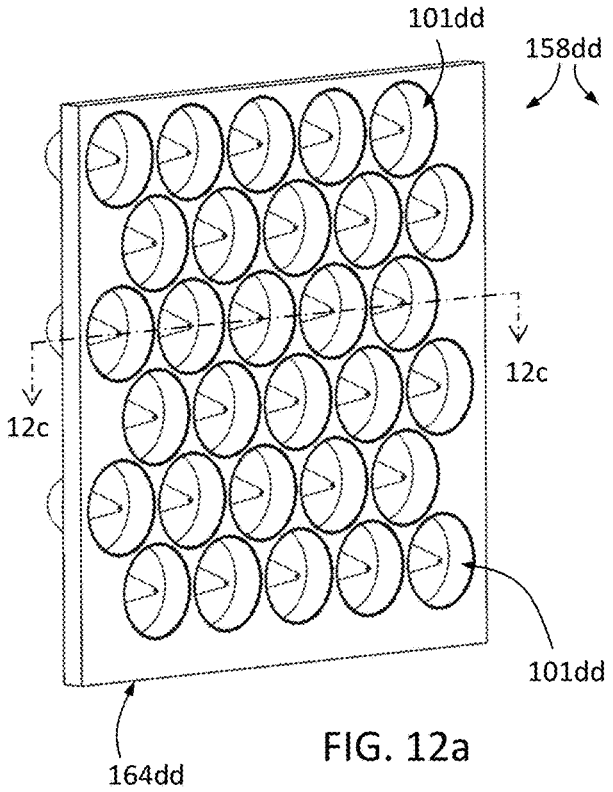
FIG. 12*a* depicts a front perspective view of a an arrayed panel of prime polygon reflectors of FIG. 10*g* according to one or more embodiments shown and described herein.
Figure 12B:
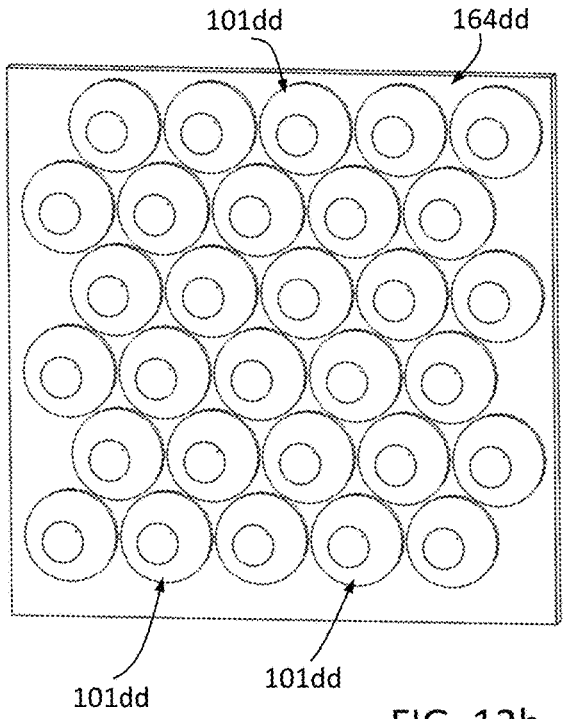
FIG. 12*b* depicts a rear perspective view of a an arrayed panel of prime polygon reflectors of FIG. 10*g* according to one or more embodiments shown and described herein.
Figure 12C:
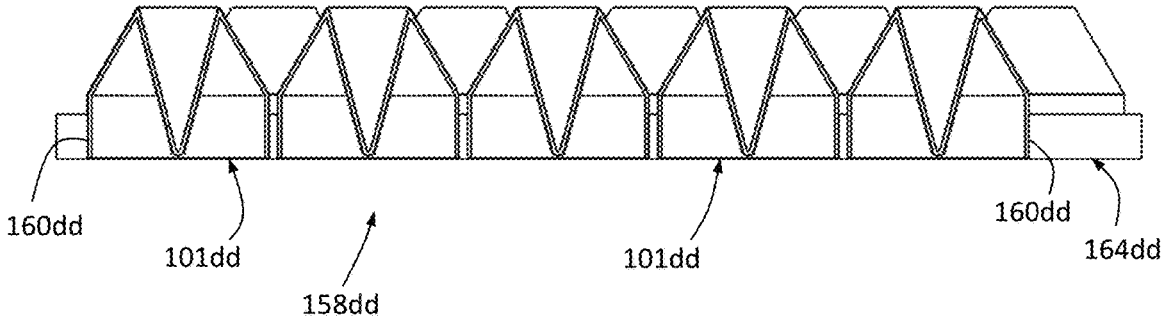
FIG. 12*c* depicts a cross sectional view of the arrayed panel of prime polygon reflectors of FIG. 12*a* according to one or more embodiments shown and described herein.

FIG. 11*a*-11*c* illustrate one embodiment of a prime polygon reflector array 158*cc* using the prime polygon reflectors 101*cc* illustrated in FIG. 9*g*. Here, an array panel 164*cc* about half the thickness of the exposure face diameter is perforated with a plurality of tapered bores 162*cc* sized to seat prime polygon reflector 101*cc* therein. Similarly, FIG. 12*a*-12*c* illustrate one embodiment of a prime polygon reflector array 158*dd* using the prime polygon reflectors 101*dd* illustrated in FIG. 10*g*. Here, an array panel 164*dd* about half the thickness of the exposure face diameter is perforated with a plurality of straight bores 160*dd* sized to seat prime polygon reflector 101*dd* therein. Preferably the prime polygon reflectors are fixed in place using adhesives, welded, etc.

Because the prime polygon is scalable, and the exposure face dimension is selected by the user or designer, there is a great deal of flexibility in being able to optimize the prime polygon reflector based on the wavelengths of energy to be absorbed and the structural design requirements of the application. Prime polygon reflectors 101*cc* and 101*dd* used in prime polygon reflector arrays 158*cc*, 158*dd* illustrated in FIGS. 11*a*-11*c* and FIGS. 12*a*-12*c* provide an open, circular exposure face that permits absorptive media to be applied by a variety of methods. To maximize absorption, panel surfaces between exposure faces may also be coated. Spraying, dipping, or even laying panels flat and pouring liquid media can produce completely filled profiles with a smooth surface finish.

Figure 15:
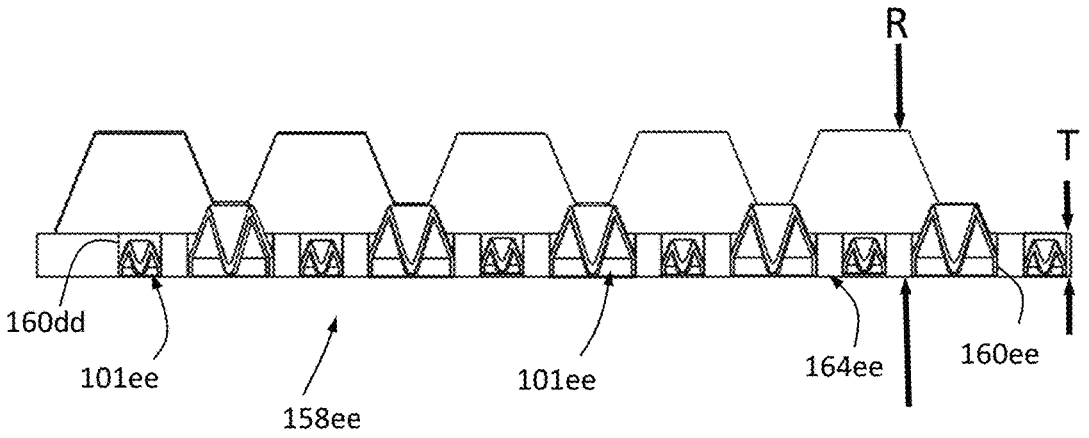
FIG. 15 depicts a cross-sectional view of the arrayed panel of multi-sized prime polygon reflectors of FIG. 13 according to one or more embodiments shown and described herein.

As illustrated in the FIG. 11*a*-11*c* embodiment, prime polygon reflectors 101*cc* are seated within a tapered bore 162*cc* extending at least partially into array panel 164*cc*. Similarly, and as illustrated in the FIG. 12*a*-12*c* embodiment, prime polygon reflectors 101*dd* are seated within a straight bore 160*cc* extending at least partially into array panel 164*dd*. As illustrated here, the bores are configured as tapered or straight, however one skilled in the art will recognize that other relationships exists for a prime polygon reflector to be seated within an array panel. In addition, the thickness of an array panel may vary. For example, as illustrated in FIG. 15, the array panel thickness T may be greater than, less than, or equal to a particular prime polygon reflector depth R. As further noted in FIG. 15, the larger prime polygon reflectors have a reflector depth R that is greater than the panel thickness T whereas the smaller prime polygon reflectors have a reflector depth T that is smaller than the panel thickness T. In alternative embodiments, the array panel thickness T may be sufficiently thick to also serve as structural support for a structure such as a building, water vessel such as a ship, or aircraft. In this embodiment, array panel 164*ee* comprises a front face 166*ee*, a rear face 168*ee*, and one or more end faces 170*ee*. When an array panel is configured to also provide structural support, the panel thickness T is typically greater than reflector depth R. In this case, bores such as straight bore 160*dd* and tapered bore 162*cc* do not extend though the rear face of the corresponding panel. In some embodiments, an array panel may comprise one or more fastening bores to house fasteners, hooks, wire, rope or other device for securing a prime polygon reflector array in a predetermined position to a wall or other structure.

Figure 13:
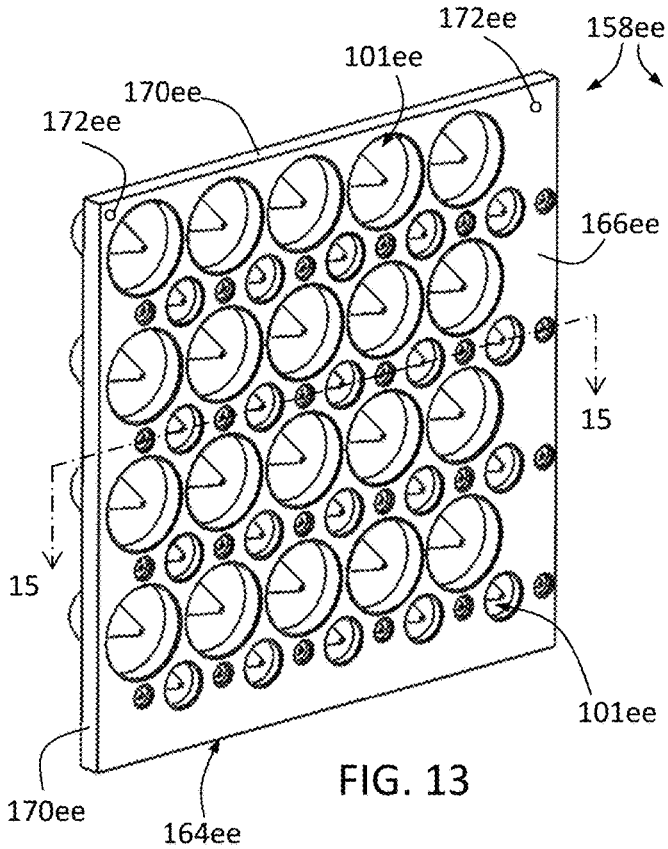
FIG. 13 depicts a front perspective view of an arrayed panel of multi-sized prime polygon reflectors according to one or more embodiments shown and described herein.
Figure 14:
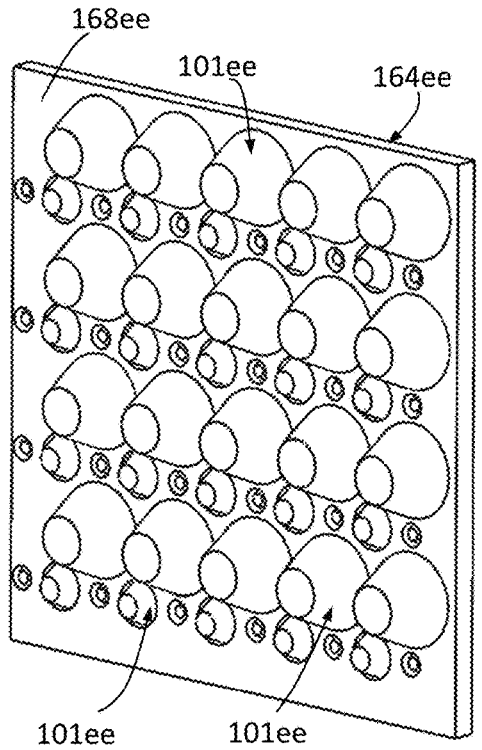
FIG. 14 depicts a rear perspective view of the arrayed panel of multi-sized prime polygon reflectors of FIG. 13 according to one or more embodiments shown and described herein.

FIG. 13-15 illustrate one embodiment of a prime polygon reflector array 158*ee* using prime polygon reflectors 101*ee* of various sizes of the type illustrated in FIG. 10*g*. Here, an array panel 164*ee* about half the thickness of the exposure face diameter is perforated with a plurality of straight bores 160*ee* sized to seat prime polygon reflector 101*ee* therein. Preferably the prime polygon reflectors are fixed in place using adhesives, welded, etc. In alternative embodiments, an array panel is perforated with tapered bores of various diameters to seat various sized prime polygon reflectors of the type illustrated in FIG. 9*g*. In yet another alternative embodiment, an array panel is perforated with a combination of tapered and straight bores for seating both types of FIGS. 9*g* and 10*g* style prime polygon reflectors. Again, these various embodiments may be configured to comprise prime polygon reflectors of a single size or a plurality of sizes.

Figure 16:
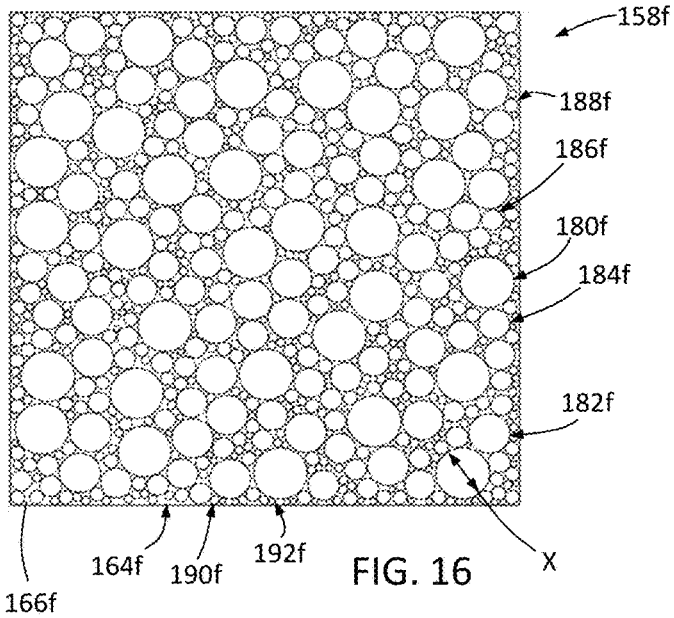
FIG. 16 depicts a front view of a non-polarized prime polygon reflector array comprising prime polygon reflectors of a range of diameters according to one or more embodiments shown and described herein.

FIG. 16 illustrates yet another example of a prime polygon reflector array 158*f*. This configuration illustrates a non-polarized array of prime polygon reflectors useful for ambient noise control as might be encountered where frequency and location of noise vary or for circularly polarized energy source. In this embodiment, the prime polygon reflectors are imprinted directly in array panel 164*f* as opposed to seated in bores as illustrated in FIG. 15 and in other Figures. As illustrated, array panel 164*f* comprises prime polygon reflectors of a range of distinct diameters. For example, the array may include one or more first prime polygon reflector 180*f* of a given diameter X, and any combination of one or more progressively smaller: second prime polygon reflector 182*f*, third prime polygon reflector 184*f*, fourth prime polygon reflector 186*f*, fifth prime polygon reflector 188*f*, sixth prime polygon reflector 190*f*, seventh prime polygon reflector 192*f* and so on. Absorption characteristics are a function of prime polygon reflector diameter and energy wavelength. Varying size of individual reflectors within a single array provides an absorption bandwidth that is tunable by the designer. As evident from FIG. 16, the combination of prime polygon reflector sizes also assists in minimizing the amount of flat surfaces between adjacent prime polygon reflectors and thus reduces the incidence of producing inverted waveform reflections, improving the effectiveness of the prime polygon reflector array. In each of these embodiments, the prime polygon reflectors are covered with an absorptive medium as previous illustrated.

Figure 17:
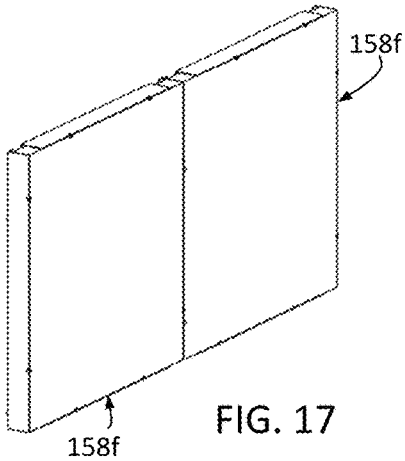
FIG. 17 depicts a perspective view of a plurality of prime polygon reflector arrays arranged at their end faces to form larger surface areas according to one or more embodiments shown and described herein and wherein the panels are shown with smooth face as they may appear after finish treatment with absorptive media.
Figure 19A:
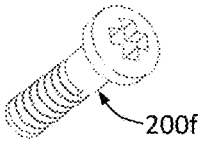
FIG. 19 depicts an exploded view of a typical panel frame utilized for mounting one or more prime polygon reflector arrays to a structure using frame fasteners in the form of screws illustrated in perspective view in FIG. 19*a* and panel retainers as illustrated in perspective view in FIG. 19*b* according to one or more embodiments shown and described herein.
Figure 19B:
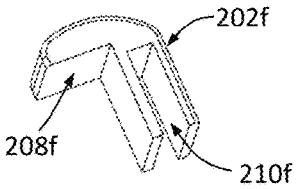
Figure 18:
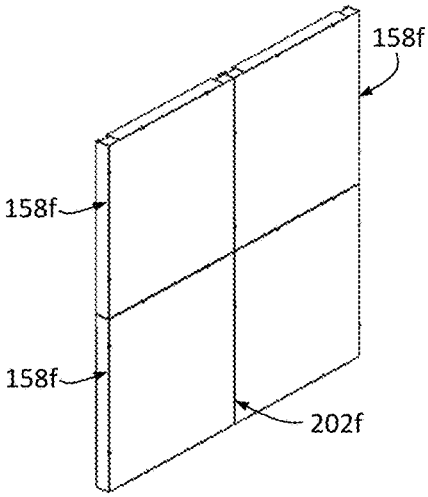
FIG. 18 depicts a perspective view of a larger plurality of prime polygon reflector arrays arranged at their end faces to form larger surface areas according to one or more embodiments shown and described herein and wherein the panels are shown with smooth face as they may appear after finish treatment with absorptive media.
Figure 19:
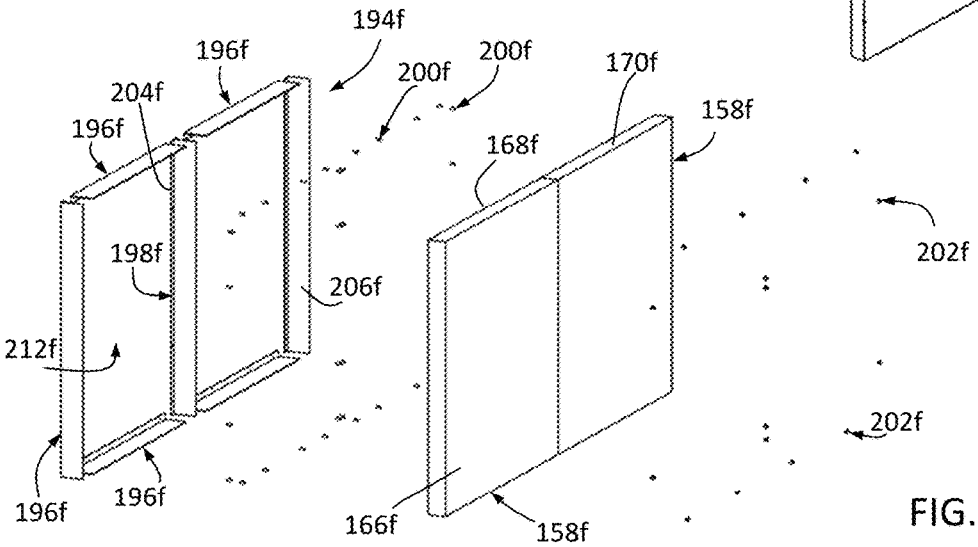

In some embodiments, a plurality of prime polygon reflector arrays are arranged at their end faces to form a larger surface areas as might be needed for example in a concert hall or airport terminal to dampen ambient noise. As illustrated in FIGS. 17-19, two or more prime polygon reflector arrays 158*f* (illustrated with absorptive media removed) are positioned adjacent each other at their ends. The prime polygon reflector arrays 158*f* may be fastened, glued, hung, or otherwise fixed to a structure using devices known in the art such as structural anchors, screws or adhesives. In some embodiments, a plurality of panel frames 194*f* may be positioned as illustrated in FIG. 19. Here, panel frame 194*f* comprises one or more end struts 196*f* that are fastened to a structure such as a wall using frame fasteners 200*f* which may be in the form of screws as illustrated in FIG. 19*a*. The end struts 196*f* comprise a base rib 204*f* having fastener holes with a panel rib 206*f* extending from the base rib. In some embodiments, an intermediate strut 198*f* is positioned between adjacent prime polygon reflector arrays 158*f*. End struts 196*f* and intermediate strut 198*f* are preferably arranged and define a complementary panel cavity 212*f* for seating a prime polygon reflector array 158*f* therein. Panel retainers 202*f* comprise a fixation face 208*f* and a rib channel 210*f*. Rib channel 210*f* is configured to engage panel rib 206*f* to fixate a prime polygon reflector array in position while fixation face 208*f* secures against front face 166*f* as illustrated in FIGS. 17 and 18. Panel anchorage, framing, and retention can take many forms depending on the application. As an example, larger arrays might utilize standard structural shapes such as angle, T, and C channel section.

In yet another embodiment, a prime polygon reflector array 158*g* is configured as a vertically polarized prime polygon absorption panel for absorption of single wavelength radar. FIGS. 20 and 21 illustrate a side and a perspective view of this type of panel based on a linear cross sectional geometry of the prime polygon reflector illustrated in FIG. 9F. In this embodiment, disposed on a front side of prime polygon reflector array 158*g* is a plurality of first reflective faces 108*g* on first reflective walls 109*g*, and a plurality of second reflective faces 114*g* on second reflective walls 115*g* which extend from opposed sides (end faces 170*g*) along axis Z. A radio frequency (RF)/radar absorptive media 133*g* covers first reflective face 108*g* and second reflective face 114*g* as illustrated in FIGS. 20 and 21. Peaks of reflective surfaces are also covered with absorptive media to eliminate reflection at these locations.

In yet another embodiment, a prime polygon reflector array 158*h* is configured as a vertically polarized prime polygon absorption panel for absorption of single wavelength radar. FIGS. 22 and 23 illustrate a side and a perspective view of this type of panel based on the linear cross sectional geometry of the prime polygon reflector illustrated in FIG. 10*f*. A RF/radar absorptive media covering the reflective surfaces has been removed from the illustration. In this embodiment, disposed on a front side of prime polygon reflector array 158*h* is a plurality of first reflective faces 108*h* on first reflective walls 109*h*, and a plurality of second reflective faces 114*h* on second reflective walls 115*h* which extend from opposed sides (end faces 170*h*) along axis Z. A radio frequency (RF)/radar absorptive media 133*h* removed from the illustration covers first reflective face 108*h* and second reflective face 114*h* as illustrated previously in FIGS. 20 and 21.

In yet another embodiment, a prime polygon reflector array 158*i* is configured as a vertically polarized prime polygon absorption panel for absorption of single wavelength radar. FIGS. 24 and 25 illustrate a side and a perspective view of this type of panel based on the linear cross-sectional geometry of the prime polygon reflector illustrated in FIG. 8 with the first exposure tab 130*c* and second exposure tab 132*c* being truncated. A RF/radar absorptive media covering the reflective surfaces has been removed from the illustration. In this embodiment, disposed on a front side of prime polygon reflector array 158*i* is a plurality of first reflective faces 108*i* on first reflective walls 109*i*, and a plurality of second reflective faces 114*i* on second reflective walls 115*i* which extend from opposed sides (end faces 170*i*) along axis Z. A radio frequency (RF)/radar absorptive media 133*i* removed from the illustration covers first reflective face 108*i* and second reflective face 114*i* as illustrated previously in FIGS. 20 and 21.

Commercial examples of RF/radar absorptive media that may be used include but are not limited to: MWT Materials® MF-500/501 Urethane, and MAST Technologies® Radar Absorbing Material (RAM).

Figure 26:
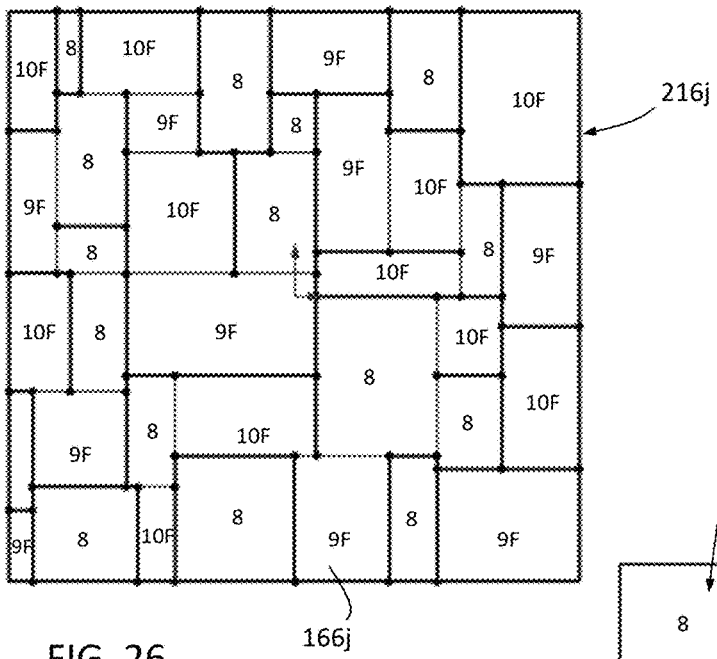
FIG. 26 is a front view of a prime polygon reflector array comprising a variety of different prime polygon reflector cross sections of varying exposure face height in various regions of the array to provide a tuned bandwidth according to one or more embodiments shown and described herein.
Figure 27:
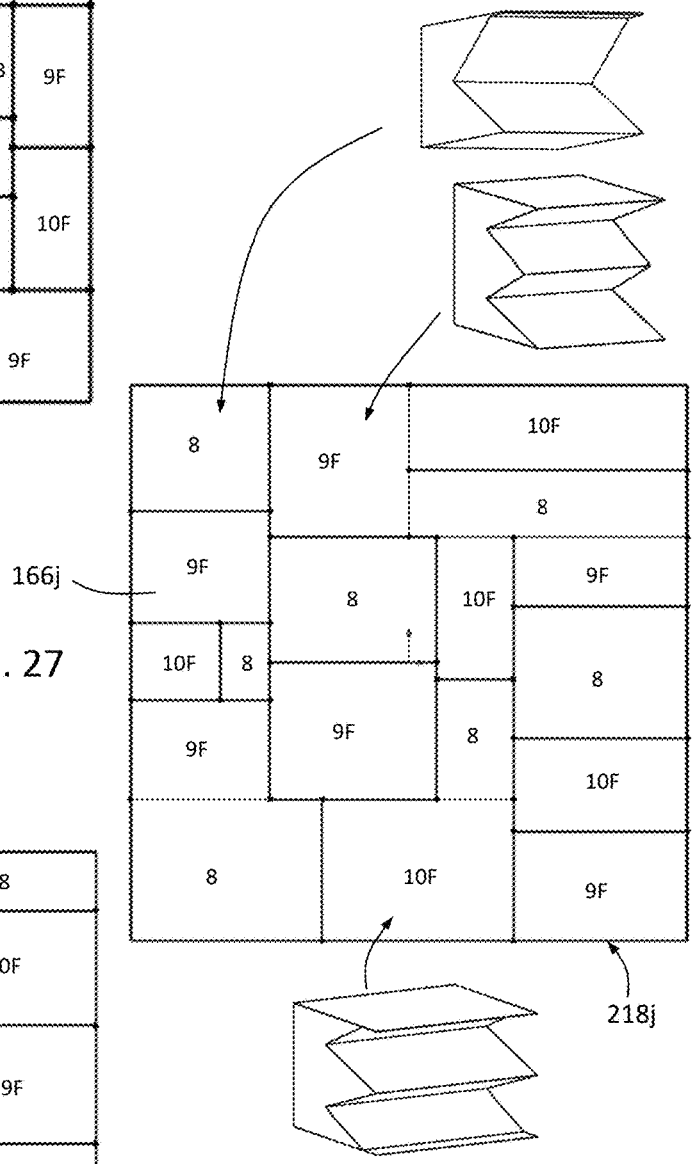
FIG. 27 is a front view of another variation of a prime polygon reflector array comprising a variety of different prime polygon reflector cross sections of varying exposure face height in various regions of the array to provide a tuned bandwidth according to one or more embodiments shown and described herein (selected prime polygon reflectors are illustrated as broken out perspective views)
Figure 28:
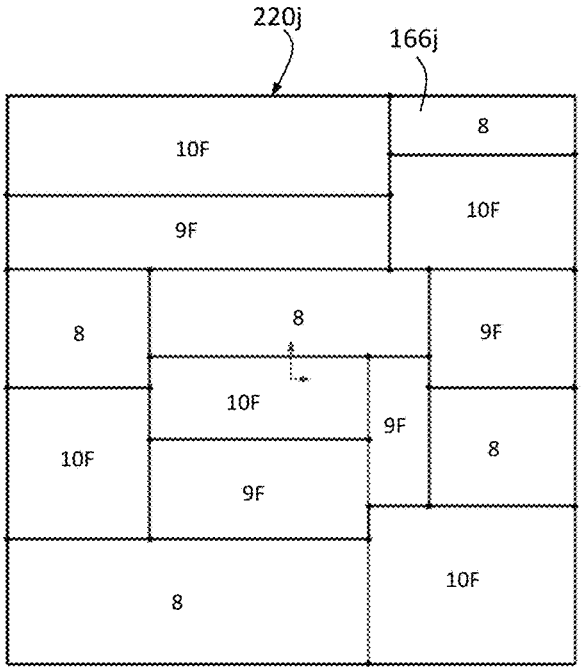
FIG. 28 is a front view of yet another variation of a prime polygon reflector array comprising a variety of different prime polygon reflector cross sections of varying exposure face height in various regions of the array to provide a tuned bandwidth according to one or more embodiments shown and described herein.

In yet another example, a vertically polarized prime polygon reflector array assembly 214*j* (FIG. 29-30) is constructed for absorption of predetermined bandwidth radar. In this embodiment, a prime polygon reflector array assembly 214*j* is made from a plurality of individual array panels. As illustrated in FIG. 26-28, a panel assembly having dimension H can comprise a range of prime polygon reflector heights based on wavelength range (bandwidth) of a predetermined radar system. Formed in the front face 166*j* of each array panel are vertical geometric prime polygon reflector sections of the type illustrated in FIG. 9F, FIG. 10F, and/or truncated FIG. 8 of varying exposure face dimensions within a specified range. The finished array panel is then coated or otherwise treated with RF/radar absorbing media which is shown as removed in some views.

In this embodiment (FIG. 29-30), a three panel variation of a prime polygon reflector array assembly 214*j* is illustrated. Represented in FIGS. 26-28 are front views of a first array panel 216*j*, a second array panel 218*j*, and a third array panel 220*j*. Regions within the front face are labeled with Figure number 8, 9F, or 10F to reference the profile of the corresponding prime polygon reflector type used in that region. The prime polygon reflector array assembly 214*j* comprises a first array panel 216*j*, a second array panel 218*j*, and a third array panel 220*j* which are sandwiched and held in an assembly by fasteners or by use of a non-reflective perimeter framing 222*j*. More or less array panels may be used in a prime polygon reflector array assembly (i.e. fourth array panel, fifth array panel and so on). In some embodiments, the array panels are identical but rotated when stacked against each other to provide variation. In other embodiments, the array panels are non-identical.

Figure 29:
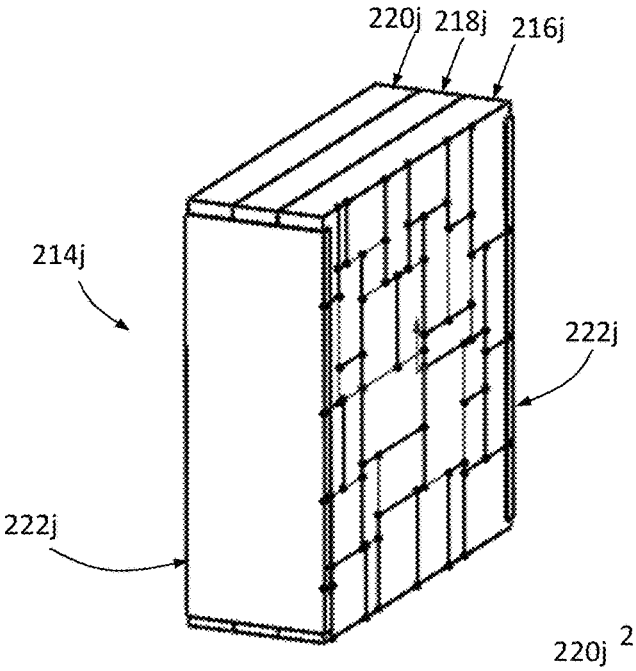
FIG. 29 is a perspective view of a custom absorption spectra created by the layering of the prime polygon reflector arrays of FIGS. 26-28 according to one or more embodiments shown and described herein.
Figure 30:
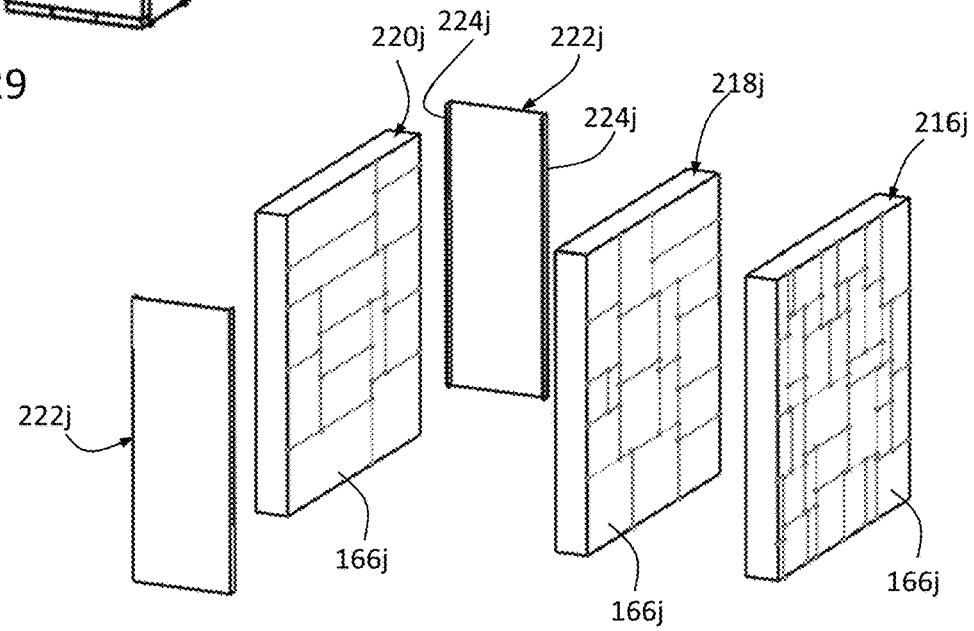
FIG. 30 is an exploded perspective view of the layered prime polygon reflector array of FIG. 29 according to one or more embodiments shown and described herein.
Figure 31:
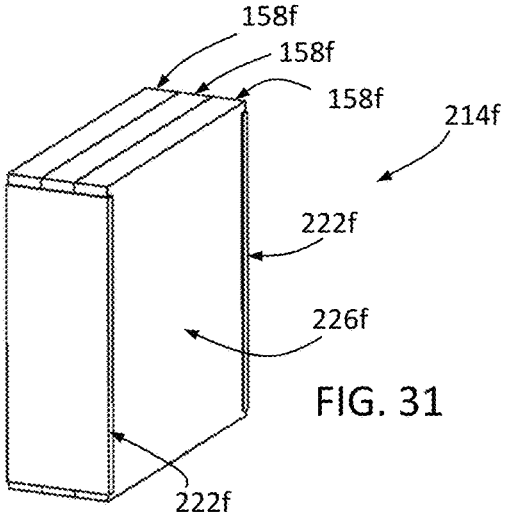
FIG. 31 is a perspective view of a custom absorption spectra created by layering of the prime polygon reflector array of FIG. 16 according to one or more embodiments shown and described herein.

A custom absorption spectra is produced by varying the exposure face Height H and layering a combination of array panels. In some embodiments, prime polygon reflectors are scribed in a front face 166*j* of an array panel by techniques such as machining, molding, stamping or die-forming into a thin reflective substrate. The illustrated panels in FIGS. 29-30 are shown with a smooth face after application of absorptive media. Similarly, as illustrated in FIG. 31, a custom non-polarized prime polygon array assembly 214*f* can be produced by layering variations of non-polarized panels (i.e. FIG. 16). Here non-polarized prime polygon reflector arrays such as 158*f* are layered. An exposed reflector populated surface 226*f* (illustrated here as smooth after application of absorptive media) absorbs incoming waveform energy. Again, in some embodiments, the array panels are identical but rotated when stacked against each other to provide variation. In other embodiments, the array panels are non-identical.

Figure 32:
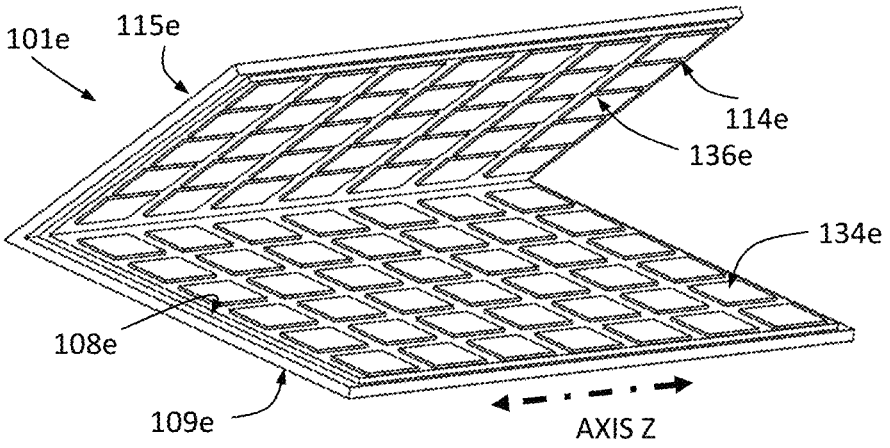
FIG. 32 is a perspective view of a truncated prime polygon reflector configured for use in the collection of solar energy according to one or more embodiments shown and described herein.
Figure 33:
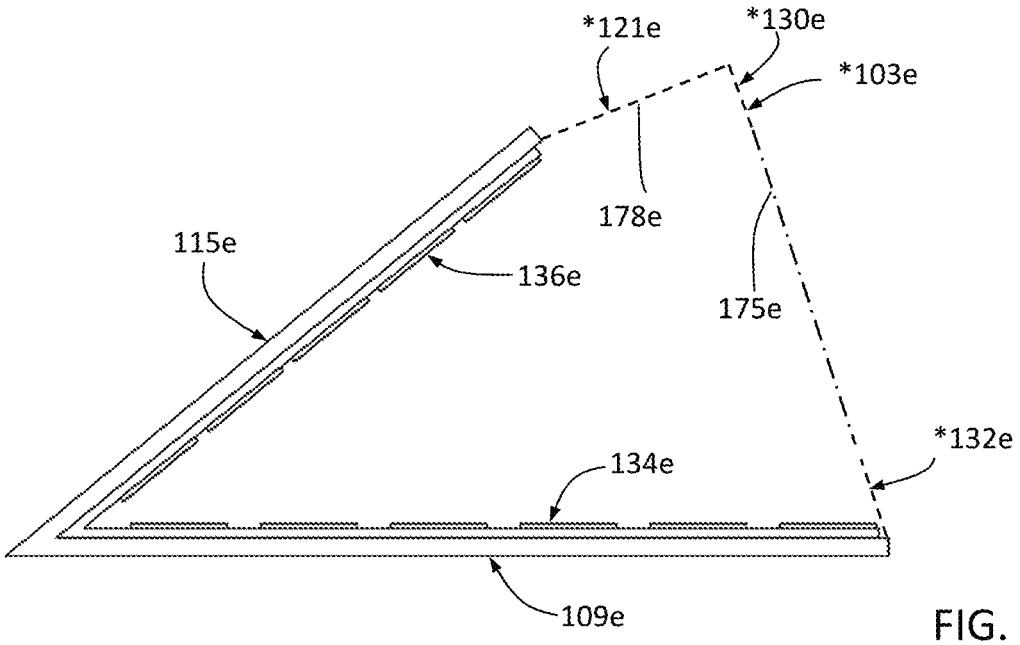
FIG. 33 is an end view of the truncated prime polygon reflector (* indicates truncated) of FIG. 31 with third reflective reference and exposure reference according to one or more embodiments shown and described herein.
Figure 34:
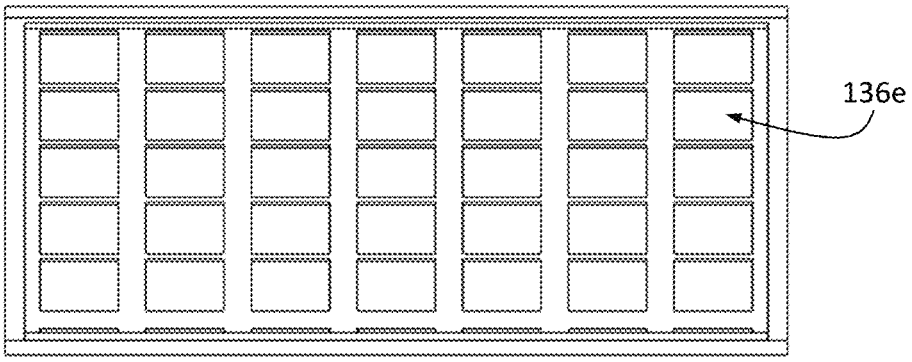
FIG. 34 is a front view of the truncated prime polygon reflector of FIG. 31 according to one or more embodiments shown and described herein.

In some applications, one or more reflective faces may be truncated due to space limitations or other reasons. For example, an exposure face may be truncated for the collection of solar energy. As illustrated in FIGS. 32-34, walls and faces of a prime polygon reflector 101*e* are truncated (signified by *) in a manner suitable for use in the collection of solar energy (i.e. dotted lines represent truncated portions of a prime polygon reflector and underlying third reflective reference 178*e* and underlying exposure reference 175*e*). In this embodiment, a first absorptive media 134*e* and second absorptive media 136*e* is in the form of solar collectors disposed adjacent the corresponding first and second reflective faces 108*e*, 114*e*. Properties of prime polygon reflector 101*e* cause incident ray energy to strike the absorptive media multiple times before exiting the prime polygon reflector back to the environment. Absorptive material in the revolved prime polygon reflectors illustrated in FIGS. 9*g* and 10*g* may alternatively be in the form of one or more of a: solar collector, solar cell, solar film, and solar coating. The foregoing invention has been described in accordance with the relevant legal standards, thus the description is exemplary rather than limiting in nature. Variations and modifications to the disclosed embodiment may become apparent to those skilled in the art and fall within the scope of the invention.

The invention claimed is:

1. A prime polygon reflector comprising:

a reflection chamber;

wherein said reflection chamber comprises an exposure reference coincident with an optional exposure wall with exposure face thereon, a first reflective wall with first reflective face thereon, a second reflective wall with second reflective face thereon, and a third reflective reference with optional third reflective wall with third reflective face thereon;

said exposure reference of predetermined length H between a first end and a second end measured inside said reflection chamber for receiving at least one of incoming: parallel ray and waveform energy;

a generally linear first reflective face;

said first reflective face bounded by a third end and a fourth end and having a nominal length of ($\sqrt{3}$ H) as measured inside said reflection chamber with a variance range between $+0.15\sqrt{3}H$ and $-0.15\sqrt{3}H$;

said third end of said first reflective face intersecting said second end of said exposure reference;

an angle $\alpha$ having a nominal value of 16.917899 degrees and a maximum value of 18.2 degrees and a minimum value of 15.5 degrees;

said first reflective face angled 90 minus $\alpha$ ($90-\alpha$) degrees from said exposure reference;

a generally linear second reflective face bounded by a fifth end and a sixth end;

said fifth end of said second reflective face intersecting said fourth end of said first reflective face;

said second reflective face angled ($90-3\alpha$) degrees from said first reflective face;

said sixth end of said second reflective face terminating at the point of intersection with a line extending orthogonal from said first end of said exposure reference toward said second reflective face;

wherein said exposure reference and said first reflective face and said second reflective face define said reflection chamber;

an absorptive media;

and wherein at least a portion of said first reflective face and said second reflective face are covered by said absorptive media.

2. The prime polygon reflector of claim 1 wherein at least one of: said exposure reference, said first reflective face, and said second reflective face are generally planar in an elongated configuration.

3. The prime polygon reflector of claim 2 wherein said exposure reference and said first reflective face and said second reflective face are positioned generally perpendicular to a common plane.

4. The prime polygon reflector of claim 1 wherein said reflection chamber is generally conically shaped and formed by rotation of one or more of said first reflective face, second reflective face and third reflective face about an axis having one end intersecting and orthogonal to said first end of said exposure reference.

5. The prime polygon reflector of claim 1 further comprising:

a generally linear third reflective face bounded by a seventh end and an eighth end;

said seventh end of said third reflective face intersecting said sixth end of said second reflective face;

said eighth end of said third reflective face intersecting said first end of said exposure reference;

wherein said exposure reference and said first reflective face and said second reflective face and said third reflective face define said reflection chamber;

an absorptive media;

and wherein at least a portion of at least one of: said first reflective face and said second reflective face and said third reflective face are covered by said absorptive media.

6. The prime polygon reflector of claim 5 wherein at least one of: said exposure reference and said first reflective face and said second reflective face and said third reflective face are generally planar in an elongated configuration.

7. The prime polygon reflector of claim 6 wherein at least one of said exposure reference and said first reflective face and said second reflective face and said third reflective face are positioned generally perpendicular to a common plane.

8. The prime polygon reflector of claim 5 wherein said reflection chamber is generally conical and formed by rotation about an axis intersecting said second end of said exposure reference and is orthogonal to said exposure reference.

9. A plurality of prime polygon reflectors according to claim 1 wherein the prime polygon reflectors are chosen from one or more of the following prime polygon reflector groups: A) wherein said reflection chamber is generally conically shaped and formed by rotation of one or more of said first reflective face, said second reflective face, and said third reflective face about an axis having one end intersecting said first end of said exposure reference and orthogonal to said exposure reference, and B) wherein said reflection chamber is generally conically shaped and formed by rotation of one or more of said first reflective face, second reflective face, and third reflective face about an axis having one end intersecting said second end of said exposure reference and orthogonal to said exposure reference; and wherein each prime polygon reflector comprises uniform or varying exposure reference length H and wherein each prime polygon reflector is positioned adjacent to others to form a prime polygon reflector array.

10. A plurality of prime polygon reflectors according to claim 2 wherein the plurality of prime polygon reflectors are chosen from one or more of the following prime polygon reflector groups: A) wherein said exposure reference and said first reflective face and said second reflective face are positioned generally perpendicular to a common plane, and B) wherein at least one of said exposure reference and said first reflective face and said second reflective face and said third reflective face are positioned generally perpendicular to a common plane;

wherein said exposure reference and said first reflective face and said second reflective face and said third reflective face define said reflection chamber; and an absorptive media;

and wherein at least a portion of one or more of said first reflective face, said second reflective face, and said third reflective face is covered by said absorptive media;

and wherein each prime polygon reflector comprises uniform or varying exposure reference length H and wherein each prime polygon reflector is positioned adjacent to others to form a prime polygon reflector array.

11. A plurality of prime polygon reflectors according to claim 1 chosen from prime polygon reflectors having features included in one or more of the following groups: A) conically shaped reflective faces formed from rotation about rotational axis 1 which has one end intersecting said first end of said exposure reference and is orthogonal to said exposure reference, B) conically shaped reflective faces formed from rotation about rotational axis 2 which has one end intersecting said second end of said exposure reference and orthogonal to said exposure reference, and C) generally planar reflective faces extending orthogonally from a common plane;

wherein said plurality of chosen prime polygon reflectors are arranged into a prime polygon reflector array; and wherein at least a portion of one or more of said first reflective face, said second reflective face, and said third reflective face is covered by absorptive media.

12. A plurality of prime polygon reflectors according to claim 11 wherein said prime polygon reflector arrays are layered to form a prime polygon reflector array assembly.

13. The plurality of prime polygon reflectors as in claim 10 wherein said prime polygon reflectors are formed into prime polygon reflector arrays and arranged into multi-layer prime polygon reflector array assemblies;

and wherein said absorptive media is in the form of one or more of electromagnetic energy absorbing coating, linings, or other surface treatment for absorption of radar signals, radar energy, and other electromagnetic energy used for radiolocation.

14. The plurality of prime polygon reflectors as in claim 11 wherein said prime polygon reflectors are formed into prime polygon reflector arrays and arranged into multi-layer prime polygon reflector array assemblies;

and wherein said absorptive media is in the form of one or more of electromagnetic energy absorbing coating, linings, or other surface treatment for absorption of radar signals, radar energy, and other electromagnetic energy used for radiolocation.

15. The plurality of prime polygon reflectors as in claim 12 wherein said prime polygon reflectors are formed into prime polygon reflector arrays and arranged into multi-layer prime polygon reflector array assemblies;

and wherein said absorptive media is in the form of one or more of electromagnetic energy absorbing coating, linings, or other surface treatment for absorption of radar signals, radar energy, and other electromagnetic energy used for radiolocation.

16. The prime polygon reflector of claim 1 further comprising:

a first cap wall with first cap face formed thereon;

a second cap wall with second cap face formed thereon;

a window extending through said exposure face;

wherein said first reflective face, said second reflective face, said third reflective face, and said exposure face extend orthogonally from a common plane between opposed end faces forming said reflection chamber therein;

wherein said first cap wall covers one of said opposed end faces and a second cap wall covers the second of said opposed end faces to form a generally enclosed reflection chamber with said window extending through said exposure wall and said exposure face and wherein one or more audio loudspeakers is disposed within said window; and wherein at least a portion of at least one of said first reflective face, said second reflective face, said third reflective face, said first cap face, said second cap face, and said exposure face are covered with absorptive media.

17. The prime polygon reflector according to claim 16 wherein one end of said window through said exposure face is positioned a distance of H/6.316011 from said first end of said exposure face as measured from inside said reflection chamber; and wherein another end of said window through said exposure face extends a general distance of H/6 from said second end of said exposure face as measured from inside said reflection chamber and wherein the aforementioned measured values have a range of variation of plus or minus 0.15H.

18. The prime polygon reflector according to claim 1 wherein said reflection chamber is one of: A) generally conically shaped and formed by rotation of one or more of said first reflective face, said second reflective face and said third reflective face about an axis having one end intersecting said first end of said exposure reference and orthogonal to said exposure reference, and B) wherein said reflection chamber is generally conically shaped and formed by rotation of one or more of said first reflective face, second reflective face, and said third reflective face about an axis intersecting said second end of said exposure reference and is orthogonal to said exposure reference;

and wherein waveform energy directed through said exposure face originates from an acoustic loudspeaker.

19. The prime polygon reflector according to claim 1 wherein said absorptive media is chosen from one or more of the following groups: solar cells, solar collectors, solar film, and solar coating for conversion of solar energy to electricity.

20. The prime polygon reflector according to claim 1 wherein ray or waveform energy passes through said absorptive media a minimum of 8 times before exiting the prime polygon reflector.

21. The prime polygon reflector of claim 1 wherein a plurality of reflectors are arranged according to one or more of: A) in an array, and B) in a multi-layer assembly.

22. The prime polygon reflector of claim 1 further comprising:

an axis Z;

wherein said axis Z is one of linear and curvilinear; and wherein said first reflective face and said second reflective face extend along axis Z.

* * * * *